US006381977B1

(12) United States Patent
Austin, Jr.

(10) Patent No.: US 6,381,977 B1
(45) Date of Patent: May 7, 2002

(54) CARGO CONTAINER AND A PALLET TRACK ASSEMBLY THEREOF

(76) Inventor: Albert A. Austin, Jr., 6 Surfsong Rd., Kiawah, SC (US) 29455

( * ) Notice: Subject to any disclaimer, the term of this patent is extended or adjusted under 35 U.S.C. 154(b) by 0 days.

(21) Appl. No.: 09/610,342

(22) Filed: Jul. 3, 2000

Related U.S. Application Data

(63) Continuation of application No. 09/059,181, filed on Apr. 14, 1998, now Pat. No. 6,109,052.
(60) Provisional application No. 60/050,197, filed on Jun. 19, 1997.

(51) Int. Cl.[7] ..... F25D 23/12
(52) U.S. Cl. ..... 62/259.1; 62/371; 414/540
(58) Field of Search ..... 62/371, 259.1; 414/537, 539, 540; 296/61

(56) References Cited

U.S. PATENT DOCUMENTS

| | | | | |
|---|---|---|---|---|
| 3,889,827 A | * | 6/1975 | Fine | 214/77 |
| 5,072,845 A | | 12/1991 | Grogan | |
| 5,245,838 A | | 9/1993 | Cavalea, III | |
| 5,403,062 A | | 4/1995 | Sjostedt et al. | |
| 5,419,456 A | | 5/1995 | Graaff | |
| 5,533,771 A | * | 7/1996 | Taylor et al. | 296/26 |
| 5,642,827 A | | 7/1997 | Madsen | |
| 5,678,715 A | | 10/1997 | Sjostedt et al. | |
| 5,702,151 A | | 12/1997 | Grote et al. | |
| 5,741,042 A | | 4/1998 | Livingston et al. | |
| 5,829,947 A | * | 11/1998 | Litten | 414/537 |
| 5,966,956 A | | 10/1999 | Morris et al. | |

FOREIGN PATENT DOCUMENTS

| | | |
|---|---|---|
| FR | 2083539 | 12/1971 |
| GB | 775 527 | 5/1957 |
| GB | 1002807 | 9/1965 |
| GB | 2 251 237 | 7/1992 |

* cited by examiner

*Primary Examiner*—William Doerrler
*Assistant Examiner*—Melvin Jones
(74) *Attorney, Agent, or Firm*—Foley & Lardner

(57) ABSTRACT

A cargo container is manufactured using mash seam welding or $CO_2$ laser welding technology. Automatic welding replaces the multiple sheets of corrugated steel used for the side and roof panels with continuous coils of steel, resulting in lower material costs and reduced material handling. A single horizontal mash-weld or $CO_2$ laser weld seam is needed to produce each panel, which are produced by joining two side-by-side sheets at their inner edges. Press and die assembly forms reinforcing ribs. Each panel has four straight welding edges, which enable automated welding. The cargo container includes a frame assembly made of tubular beams. The container further contains a pallet roller track assembly to facilitate loading and unloading of cargo to and from the container, and securing the pallet carrying the cargo to the container.

20 Claims, 23 Drawing Sheets

CARGO CONTAINER AND A PALLET TRACK ASSEMBLY THEREOF

This is continuation of application Ser. No. 09/059,181 filed Apr. 14, 1998 now U.S. Pat. No. 6,109,052, which claims priority to Provisional Application Ser. No. 60/050,197, filed Jun. 19, 1997.

BACKGROUND

Dry-cargo marine containers come in many sizes, e.g., 20, 40, 45, 53 feet in length, typically rectangular or box-like, designed to be stacked one upon another according to ISO 1161 standard, for example. More specifically, ISO class containers come in following sizes: 20' (length)×8' (width)×8'6" (height); 40'×8'×8'6"; and 40'×8'×9'6" (Hi cube). Domestic class containers come in following sizes: 45'×8'6"×9'6" and 53'×8'6"×9'6". Referring to FIG. 1, a conventional container 10 of this type has a base assembly 12, four vertical corner posts 16 extending vertically from four lower corner fittings 14, two upper side and two upper cross beams 18 connected together to the four corner posts 16 via four upper corner fittings 20. The corner posts 16 extend between each pair of container's four upper and lower corner fittings 20, 14. The base assembly includes a floor panel (not shown) supported between a pair of lower side beams 18' and a pair of lower of cross beams 18. These beams and posts are typically made of bent sheet metal angles and channels.

The container(s) stacked above are designed to sit on the top four corner fittings 20 so that it, with the respective four corner posts 16, transmits weight to the bottom four corner fittings of the base assembly and to any internal frame at the front and rear sides.

The container of this type further includes a roof panel 22, two longitudinal side panels 24, a front assembly and a door assembly, and the floor. The side panels 24 generally support the roof and any objects resting or accumulated thereon, such as snow or ice. The container(s) stacked above is not designed to exert downward load on the roof or the four side panels. Thus, the side panels are not under compression from top to bottom. They, however, do act as diagonal braces to the frame since the side panels are welded to the side and cross beams 18, 18', and the corner posts 16 at their four edges.

Typically, each of the panels 22, 24 is formed from a plurality of corrugated sheets of commercial quality steel joined side-by-side by welding so that the joined seams run generally perpendicularly to the length of the panel. See FIG. 2. FIG. 1 shows the corrugation 30 more clearly. The corrugation, which is necessary to add strength or rigidity to the panel, are typically formed by a brake press.

Referring to FIG. 2, a plurality of corrugated steel sheets are butt welded side-by-side using traditional wire fill arc-welding techniques. This welding is slow and difficult to automate. Further, the arc-welding technique and the butt welding construction require a thicker panel than would be normally required for other types of welding.

Each side panel is welded to the horizontally extending side beams 18, 18' at their upper and lower corrugated edges. Specifically, during the following framing operation, the side panels are hung vertically while the undulating bottom edge is welded to the lower side beams 18' using conventional arc welding techniques. See FIG. 10C. This welding is slow and difficult to automate because of the undulating nature and lack of dimensional uniformity of the corrugation, and the poor fit-up to the base assembly 12. Moreover, the manufacturing tolerance variations generated with the conventional cargo container designs and manufacturing processes make the automatic welding and assembly even more difficult. Further, because the panel has to be arc-welded or has butt welding construction or both, the panel has to be thicker than necessary, wasting material.

There is a need to automate cargo container assembly without the aforementioned drawbacks. The present invention meets this need.

SUMMARY

The present invention relates to a non-corrugated panel and a method of forming the panel, which can be used to make a stackable container. Another aspect of the invention is a container constructed of the present panel. Each of the panel has flat portions along the edges, with longitudinally spaced apart reinforcing ribs, which extend substantially along the entire width or height of the panel. Spacing is provided between the two long edges and the longitudinal ends of the ribs so that at least the two long edges remain flat therealong. This makes welding easy and economical. Of course, it is preferable to make the other two ends with flat portions too.

Specifically, a metal panel according to the invention comprises first and second elongated metal sheets each of a predetermined width. The first and second sheets are positioned side-by-side and overlapped by a predetermined amount. The overlapped area is then welded, preferably by mash seam or $CO_2$ laser welding. Reinforcing ribs are formed, longitudinally spaced and extending substantially perpendicularly to the longitudinal direction of the joined metal sheets. The ribs end before the outer edges of the first and second joined metal sheets to provide four welding portions, each of a predetermined width, such as ½" to 1" for example, having a flat continuous welding area along the respective edge.

The ribs can all extend in one direction and are preferably spaced apart by an approximately equal amount.

A cargo container according to the invention comprises a frame assembly having a floor panel, a front panel, two side panels, a door panel, and a roof panel all connected to the frame assembly preferably by welding. At least one of the front panel, the two side panels, and the roof panel has a reinforced panel construction as described above. Preferably, each of the side and roof panels has the reinforced panel construction. The front and door panels, as well as the floor panel can all have the reinforced panel construction.

The frame assembly preferably comprises a base assembly, a pair of spaced apart upper side beams, a pair of spaced apart upper cross beams, and four corner posts connecting the base assembly to the upper side and cross beams. The base assembly includes a pair of lower side beams each having a flat vertical portion and a pair of lower cross beams.

One of the four flat welding portions of each side panel is welded to the vertically flat portion of one of the lower side beam and the remaining three welding portions are welded to one of the upper side beams and two vertical posts connected to that side beam. The roof panel is welded to the upper side beams and upper cross beams. The reinforcing ribs of the side panels extend preferably into the container and the reinforcing ribs of the roof panel extend preferably upwardly and outwardly.

According to the invention, at least one of the upper and lower side and cross beams is tubular. Preferably, all of the beams and all of the corner posts are tubular. The tubular beams can be rectangular or L-shaped welded sheet metal tubing. For example, the front corner posts can be the L-shaped tubing and the upper and lower side and cross beams can be rectangular tubes.

A method of forming a panel comprises providing first and second elongated metal sheets each of a predetermined width and an indefinite length; positioning the first and second sheets side-by-side; overlapping adjacent longitudinal edges of the first and second sheets by a predetermined amount to form a lapped area; welding the lapped area to form a panel blank of an indefinite length; cutting the panel blank to a predetermined length; and forming a plurality of elongated reinforcing ribs extending substantially perpendicularly to the longitudinal direction of the panel and leaving four flat welding portions near along the four edges of the panel.

Preferably, the panel blank is cut to the predetermined length before forming the reinforcing ribs. Although each of the four flat welding portions can be made to any dimension, it preferably has at least a ½" width running along the peripheral edge of the panel. The welded seam is then preferably flattened, using for instance, planish rolls.

A method of forming a container comprises a) providing a container frame having a base assembly, a pair of spaced apart upper side beams, a pair of spaced apart upper cross beams, and four corner posts connecting the base assembly to the upper side and cross beams; b) providing two side panels each having four flat welding portions for bracing against the upper side beam, two corner posts and the base assembly; c) securing one of the side panels against the upper side beam, the two corner posts, and the base assembly; d) mash seam or $CO_2$ laser welding the four flat welding portions to the upper side beam, the two corner posts, and the base assembly; and e) repeating acts c) and d) for the other side panel.

A roof panel having four flat welding portions formed around the perimeter can also be secured to the upper side beams and upper cross beams. Then, the welding strips can be mash or $CO_2$ laser seam welded to the upper side and cross beams. According to the invention, the mash or $CO_2$ laser seam welding can be automated.

A container made according to the invention is suitable for all current standard sizes of ISO and Domestic dry cargo, open top, ventilated, reefer (refrigerating) containers, and atmospherically controlled container for organic and inorganic goods.

BRIEF DESCRIPTION OF THE DRAWINGS

These and other features, aspects, and advantages of the present invention will become more apparent from the following description, appended claims, and accompanying exemplary embodiments shown in the drawings, which are briefly described below.

DESCRIPTION

I. Panel Construction

Figure 3:
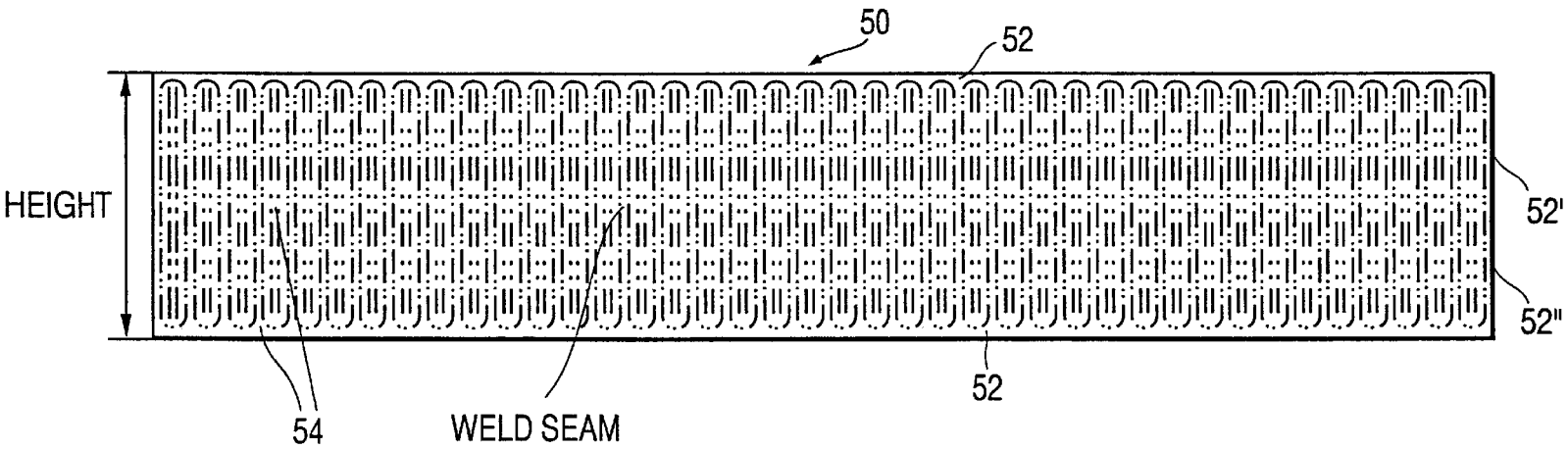
FIG. 3 (PRIOR ART)
FIG. 3 schematically illustrates a non-corrugated side panel according to the present invention.
Figure 4:
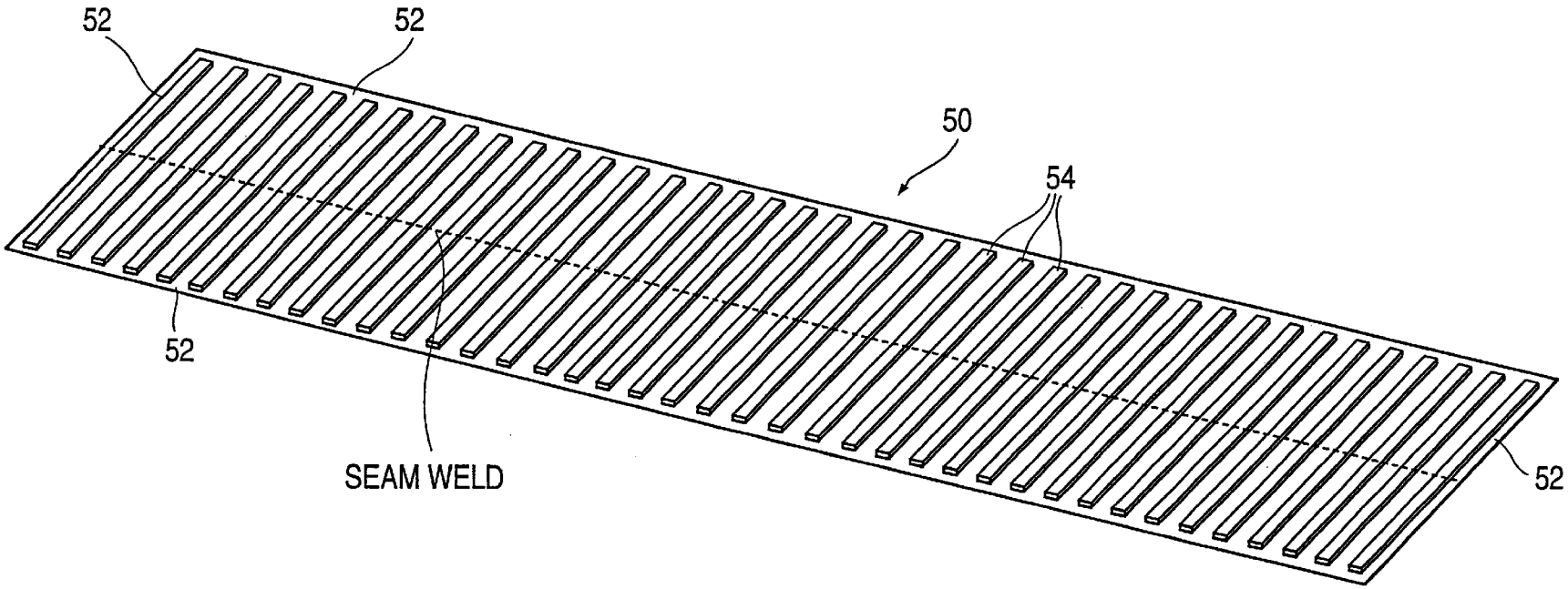
FIG. 4 illustrates a perspective view of the non-corrugated side panel of FIG. 3, showing reinforcing ribs extending upwardly.

Referring to FIGS. 3 and 4, a panel 50 according to the present invention is formed of a sheet metal and has reinforcing ribs 54 that protrude preferably from one side. FIG. 3 schematically shows the panel, with the ribs extending into the page. FIG. 4 shows the perspective view of the panel 50 showing the other side (ribs extending up).

The panel 50 is preferably formed by longitudinally joining two metal sheets 52' and 52" (of narrower widths), by welding, preferably mash or lap seam welding (which applies high pressure and heat to overlapped sheets) or $CO_2$ laser welding. The sheets can be any conventional commercial quality or grade, or any other suitable material. According to the invention, the panel has only one seam continuously running in the longitudinal direction of the panel. The conventional panel on the other hand has many seams spaced apart in the longitudinal direction and run perpendicular to the longitudinal direction of the panel, making automation more difficult.

The reinforcing ribs 50 are preferably evenly spaced along the longitudinal length of the panel and can extend substantially across the entire width or height of the panel at least to approximately within ½" of an inch of the two long edges of the metal sheet to form a straight, continuous welding portion. Of course, the ribs can be made shorter or be made of a plurality of smaller ribs and the welding portion to any desired dimension. According to the invention, the ribs 54 end deliberately before the edges to provide the continuous flat welding portion or strip 52 along each of its two longitudinal edges. The welding strips 52 remain straight and flat, which makes welding easier and more economical. The welding portions can have a width of about ½" to about 1". This width can be varied as necessary. The panel edges are straight and square, instead of being corrugated.

Figure 4A:
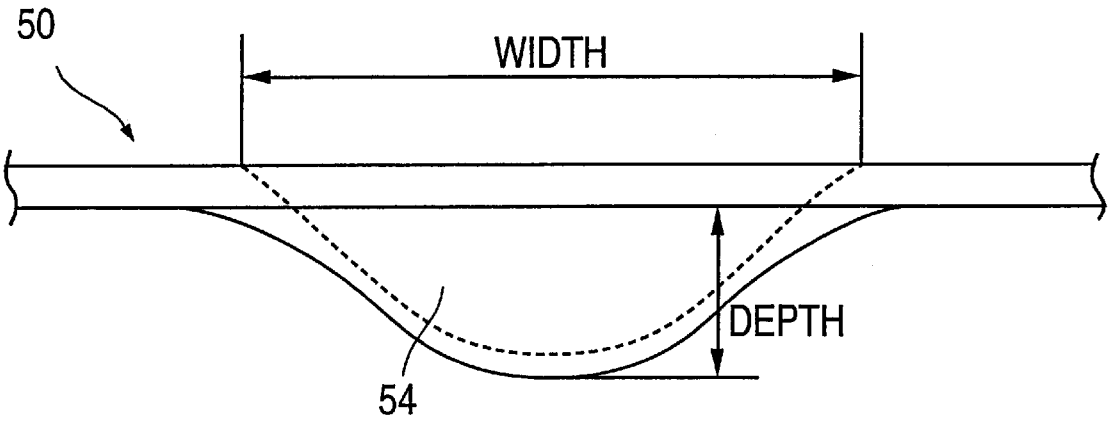
FIGS. 4A and 4B schematically illustrate various embodiments of reinforcing ribs that can be used with the side panel shown in FIGS. 3 and 4.
Figure 4B:
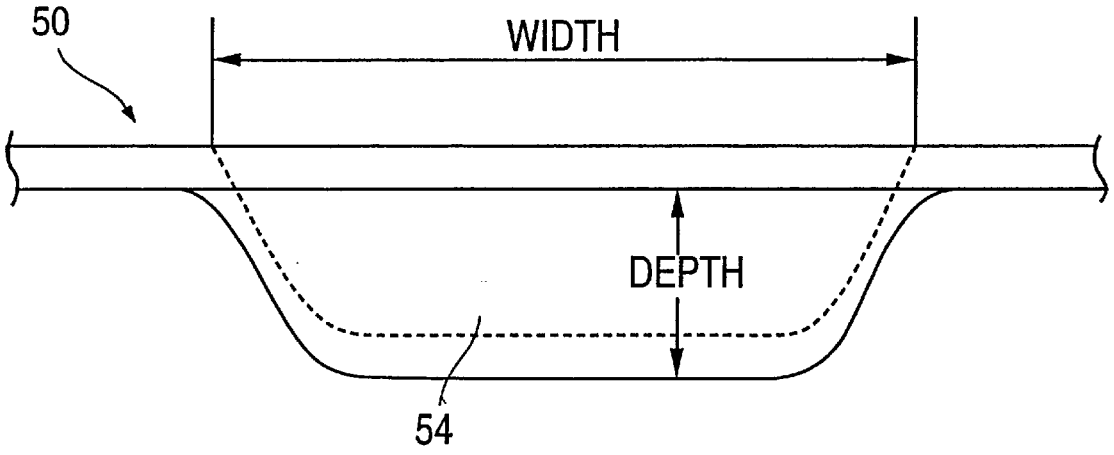

As shown in FIGS. 3 and 4, the ribs 54 are evenly spaced apart along the longitudinal direction of the panel and all extend in the same direction. Alternatively, it is possible to alternate the direction in which the ribs extend. For example, every other rib can be extruded in one direction while the ribs therebetween can be extruded in the opposite direction. FIGS. 4A and 4B show two different shapes of the ribs 54, which can be varied by changing the width and depth of the ribs.

Because the longitudinal welding strips 52 of the panel 50 are straight and flat, it is now economically feasible to automate welding. Many welding robots, which can have built in weave capability and joint sensors, can be replaced with straight line traveling welding machines of the mash seam welding or $CO_2$ laser welding varieties.

One or more of the panels as described above can be used to construct a cargo container, for example, suitable for all current standard sizes of ISO and Domestic dry cargo containers, open top, ventilated, and reefer (refrigerating) containers, and atmospherically controlled containers for organic and inorganic goods. The present panels can be used as the two longitudinal side panels, the roof panel, the front panel, the door panel, and even the floor panel of a container. On reefer containers, these panels can be used for the outer walls, e.g., roof, floor, front, side panels.

II. Container Construction

FIGS. 5–10 illustrate the assembly of one container embodiment according to the present invention. The container concept according to the invention, in addition to ISO and Domestic cargo uses, can be applied to truck trailers and train cars, for example.

Figure 5:
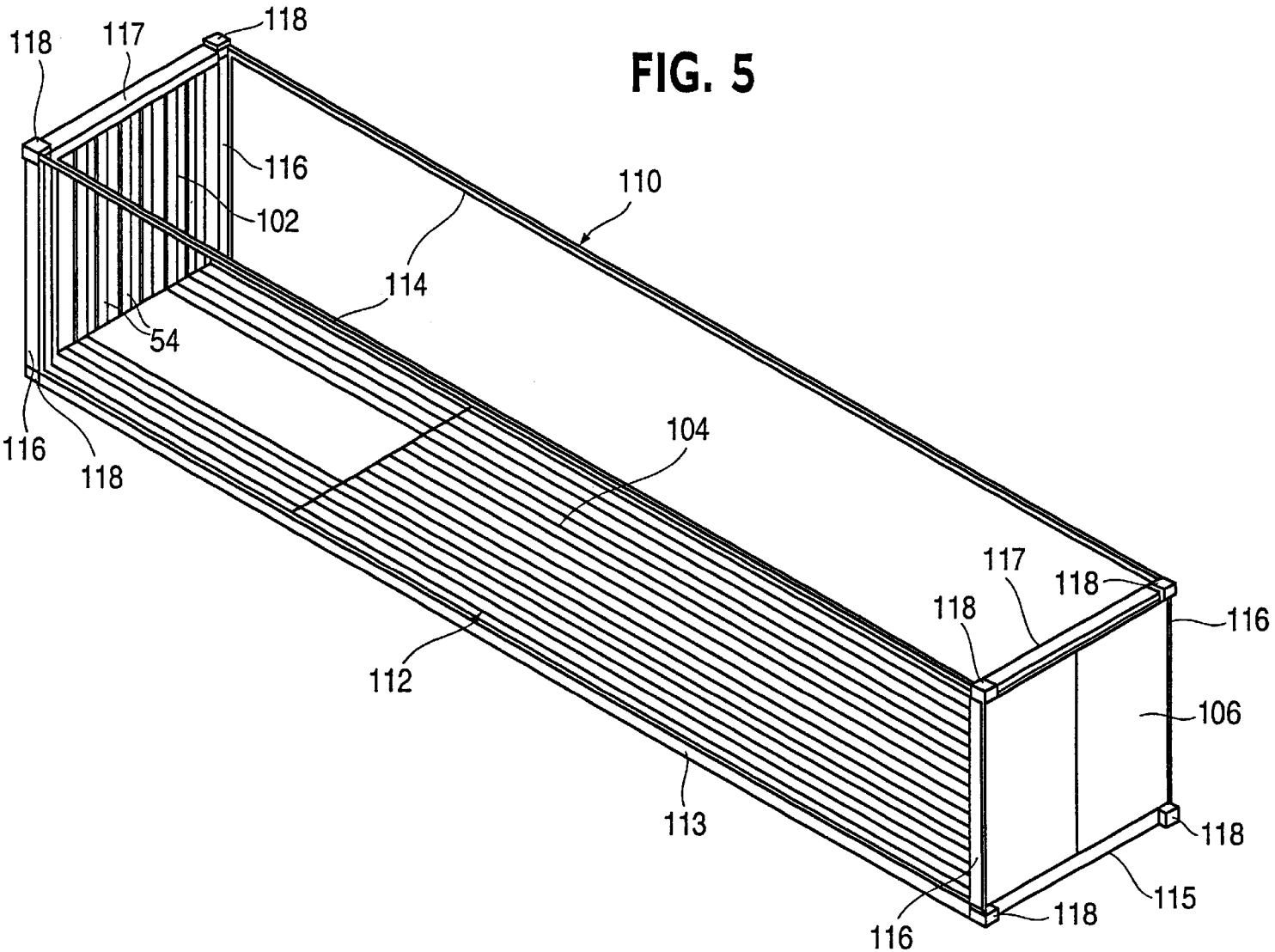
FIG. 5 illustrates a container frame with a conventional door assembly and a front panel according to the invention assembled thereto.
Figure 6:
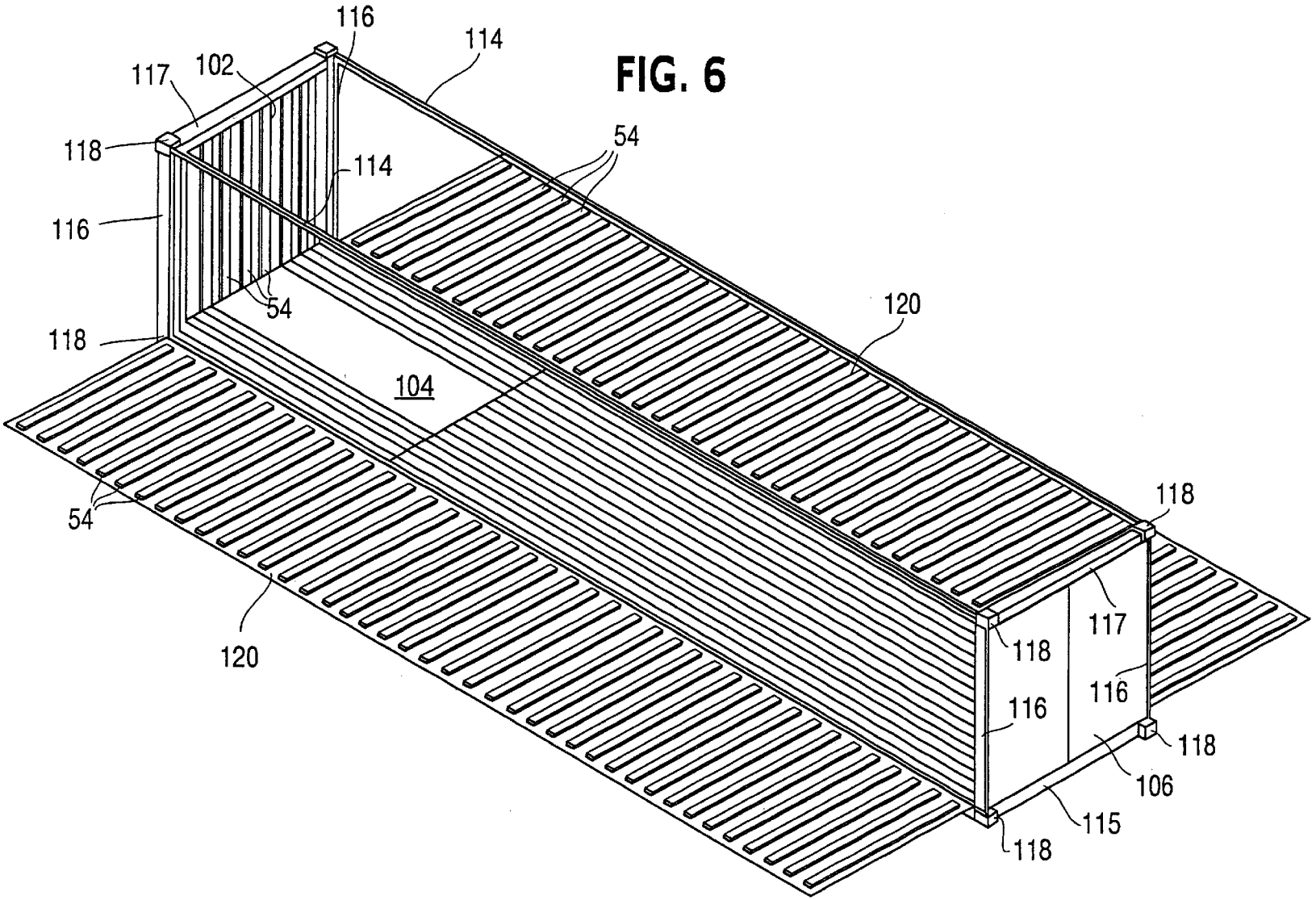
FIG. 6 illustrates the container frame of FIG. 5 with the two side panels according to the invention positioned adjacent to the frame.

This embodiment shows a container 100 comprising a frame 110 (as more clearly shown in FIG. 5). The container 100 further includes a front panel 102, a door panel 106, two longitudinal side panels 120 and a roof panel 122 attached to the frame 110 by welding. See FIGS. 6–8.

Figure 1:
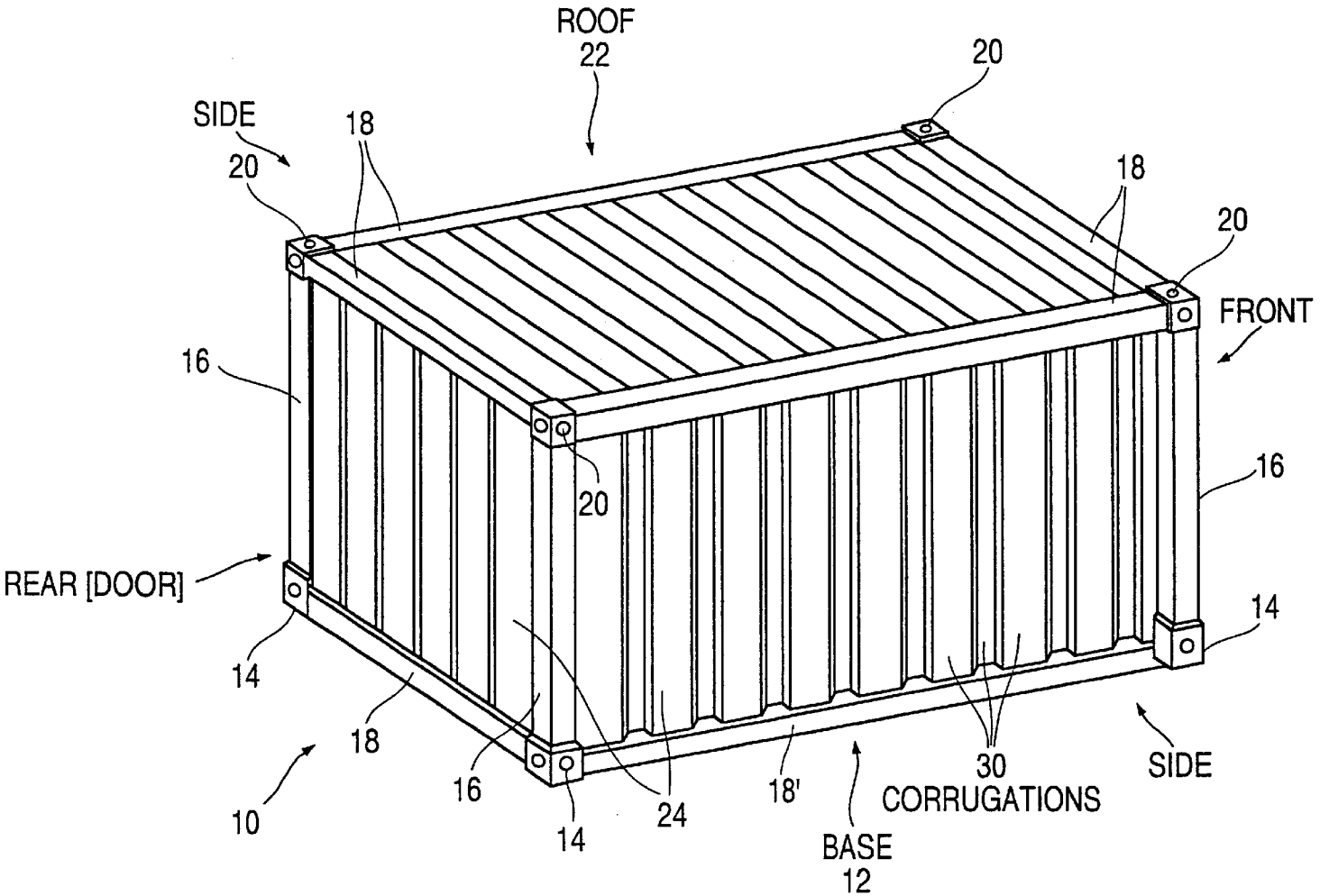
FIG. 1 (PRIOR ART)
FIG. 1 illustrates a conventional cargo container.
Figure 2:
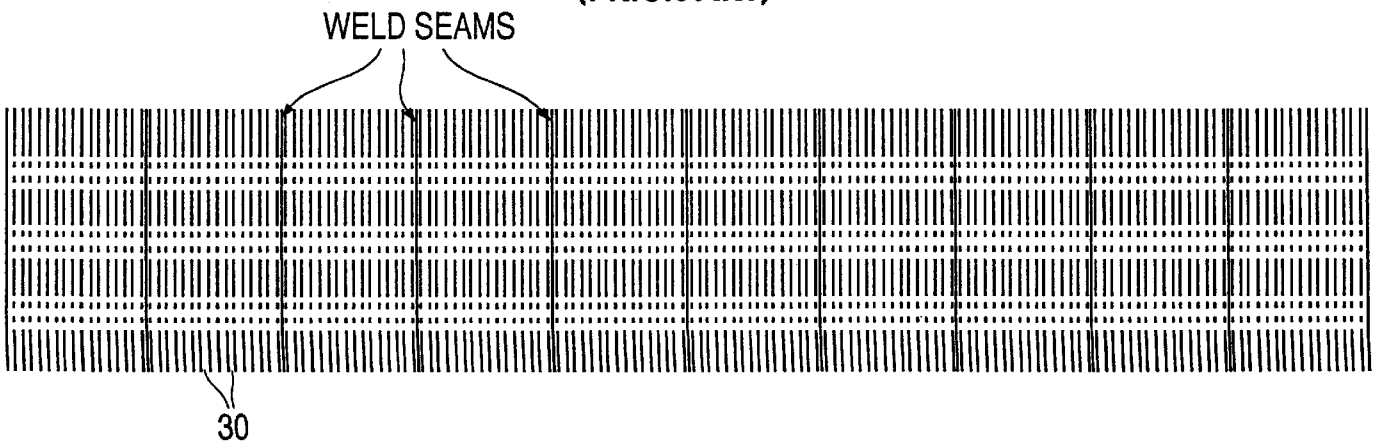
FIG. 2 (PRIOR ART)
FIG. 2 schematically illustrates a conventional corrugated side panel for the container of FIG. 1.

The frame 110 can be substantially the same as the conventional ISO cargo frame, as substantially described in reference to FIG. 1. FIG. 5 shows the frame 110 including: a base assembly 112, which includes a base frame (not shown in detail) and a floor panel 104 (such as a conventional wood floor type), two upper side rails 114 arranged parallel to each other in the same horizontal plane, four vertical corner posts 116 arranged parallel to each other and extending between four pairs of upper and lower corner fittings 118, and two upper cross beams 117 arranged parallel to each other in the same horizontal plane and extending between two pairs of the upper corner fittings 118 in the same plane. The base frame assembly includes two lower cross beams 115 arranged parallel to each other in the same horizontal plane and two lower side beams 113 arranged parallel to each other in the same horizontal plane. The vertical corner posts 116 and the upper cross beams 117 can be preassembled as part of the conventional door assembly and the front panel assembly. This type of frame is well known in the cargo industry and thus is not described in detail. The frame structure of the standard ISO and Domestic cargo container frame, is incorporated herein by reference. The components or the assembly deemed to be different from the conventional frame, however, are described.

According to the invention, at least one of the front, side, roof, and floor panels is constructed of the panel 50 previously described in reference to FIGS. 3 and 4. More preferably, at least both of the side panels 120 and the roof panel are constructed of the present panel construction 50. The front panel 102, the floor panel 104 (included with the lower frame assembly 112), and the door panel 106 can be constructed of conventional panels or the present panel construction 50. The embodiment shown in FIGS. 5–10 has the front, both side, and the roof panels 102, 120, and 122 constructed of the panel construction 50, although all of the exterior panels can be of the present panel construction 50.

Figure 7:
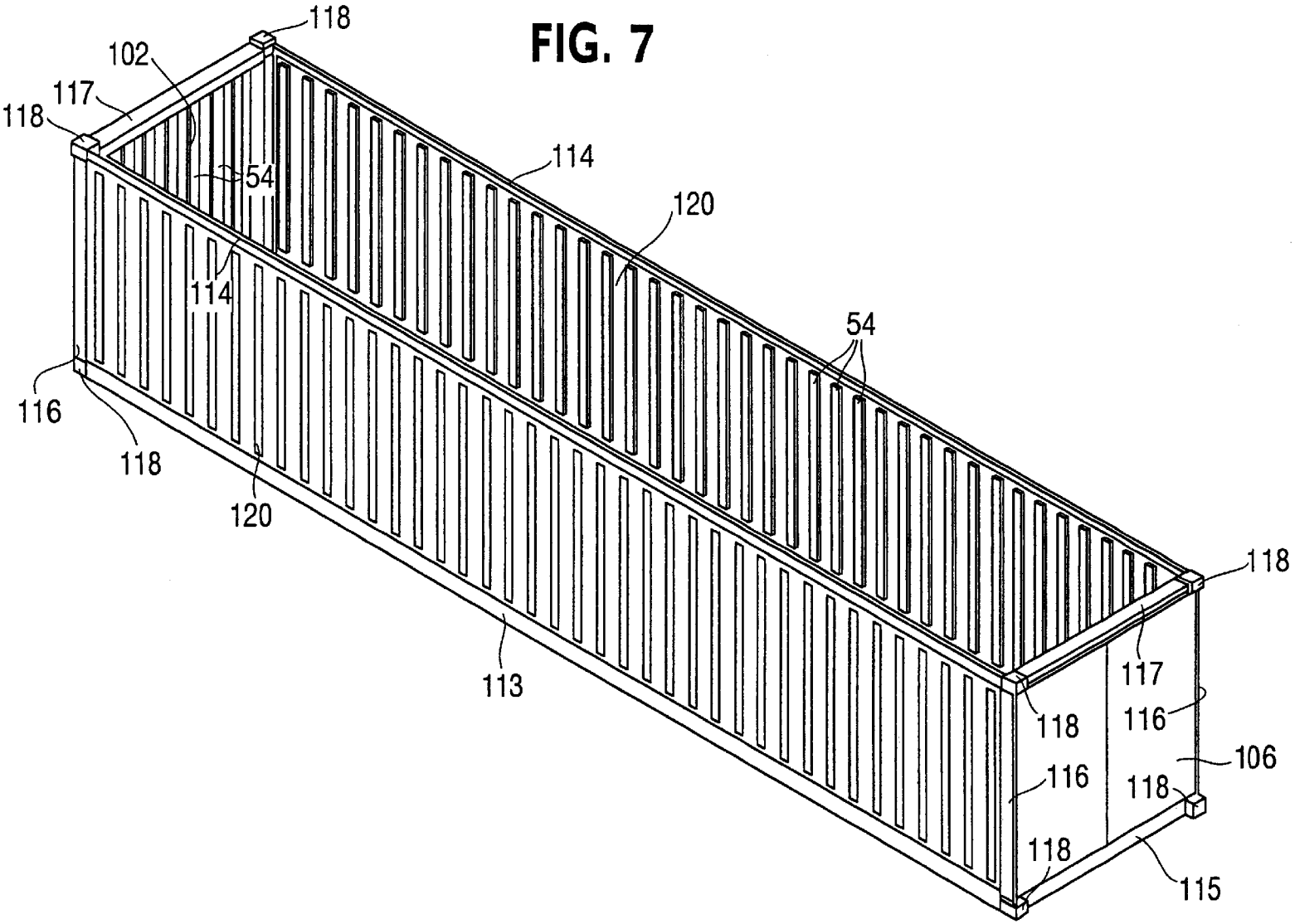
FIG. 7 illustrates the container frame of FIG. 5 with the two side panels welded to the frame.
Figure 8:
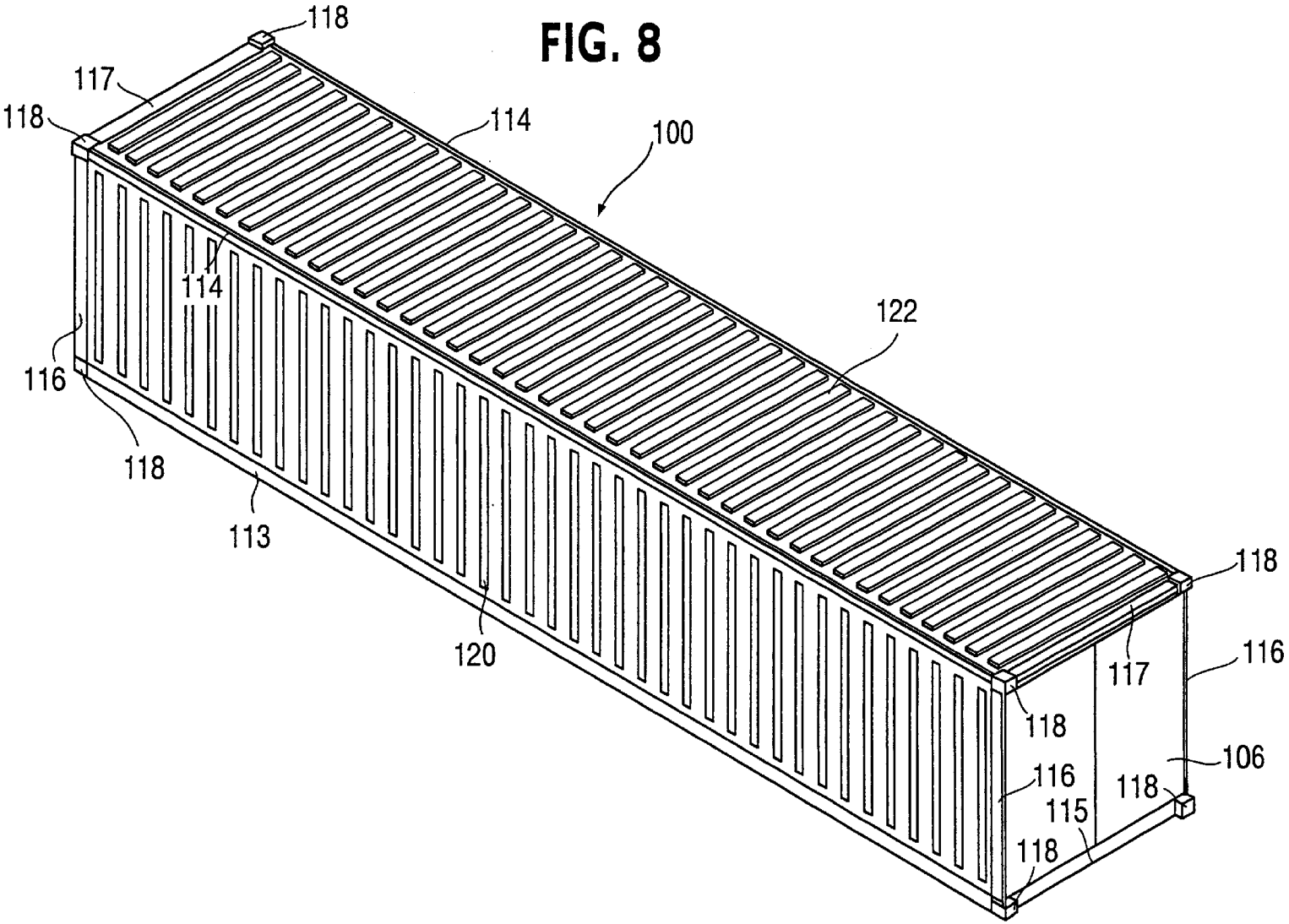
FIG. 8 illustrates the assembled container according to the invention.

Referring to FIGS. 7 and 8, the front panel 102 and the side panels 120 are welded to the frame preferably with the ribs 54 extending into the container. The roof panel 122, however, is welded to the frame preferably with the ribs 54 extending outwardly (upwardly). When the ribs 54 are formed, one side is pushed into the opposite side to form cavities (not numbered). To prevent water or foreign debris from accumulating in the horizontally oriented panel (e.g., the roof panel 122), the cavities formed by the ribs 54 are positioned facing downwardly. Thus, the ribs extend outwardly (upwardly). Similarly, if the present panel construction 50 is used as a floor, the ribs are positioned upwardly, extending into the container.

According to the embodiment shown in FIGS. 5–10, the front panel 102, the side panels 120, and the roof panel 122 each have two flat, continuous welding strips 52, each defined between the longitudinal edge and the end portions of the ribs 54. Each of the shorter sides also has a flat, continuous welding strip 52 between the edge and the longitudinal edge of the rib 54. See FIG. 4. Preferably, each of the four strips 52 has at least ½" to 1" width. It should be noted that the corners of the roof, side, or floor panels can have appropriate cutouts to accommodate the corner fittings 118 or any frame portions so that the ends of the panels can be welded to the vertical posts 116 and upper and lower cross beams 115, 117.

Figure 9:
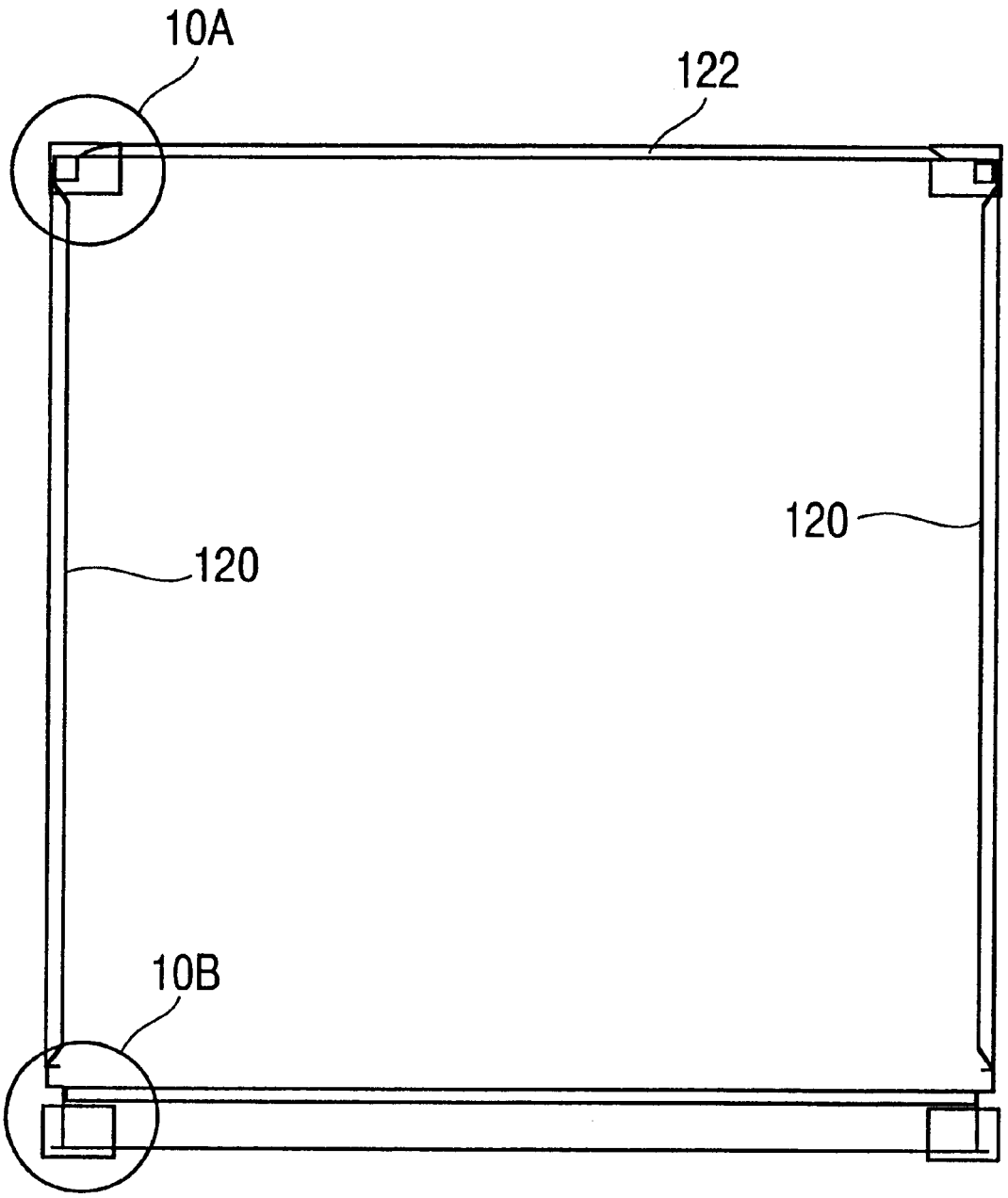
FIG. 9 illustrates a cross section of the assembled container of FIG. 8.
Figure 10A:
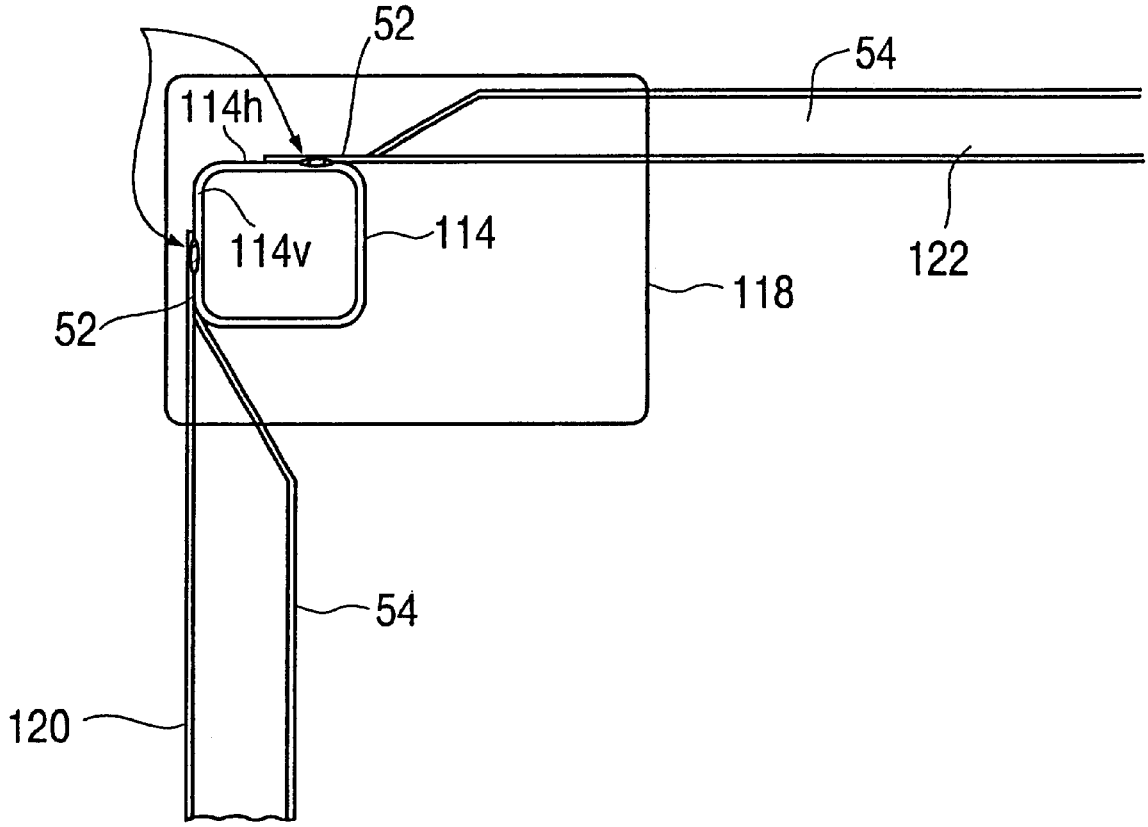
FIG. 10A illustrates a blown-up view taken along section 10A of FIG. 9.
Figure 10B:
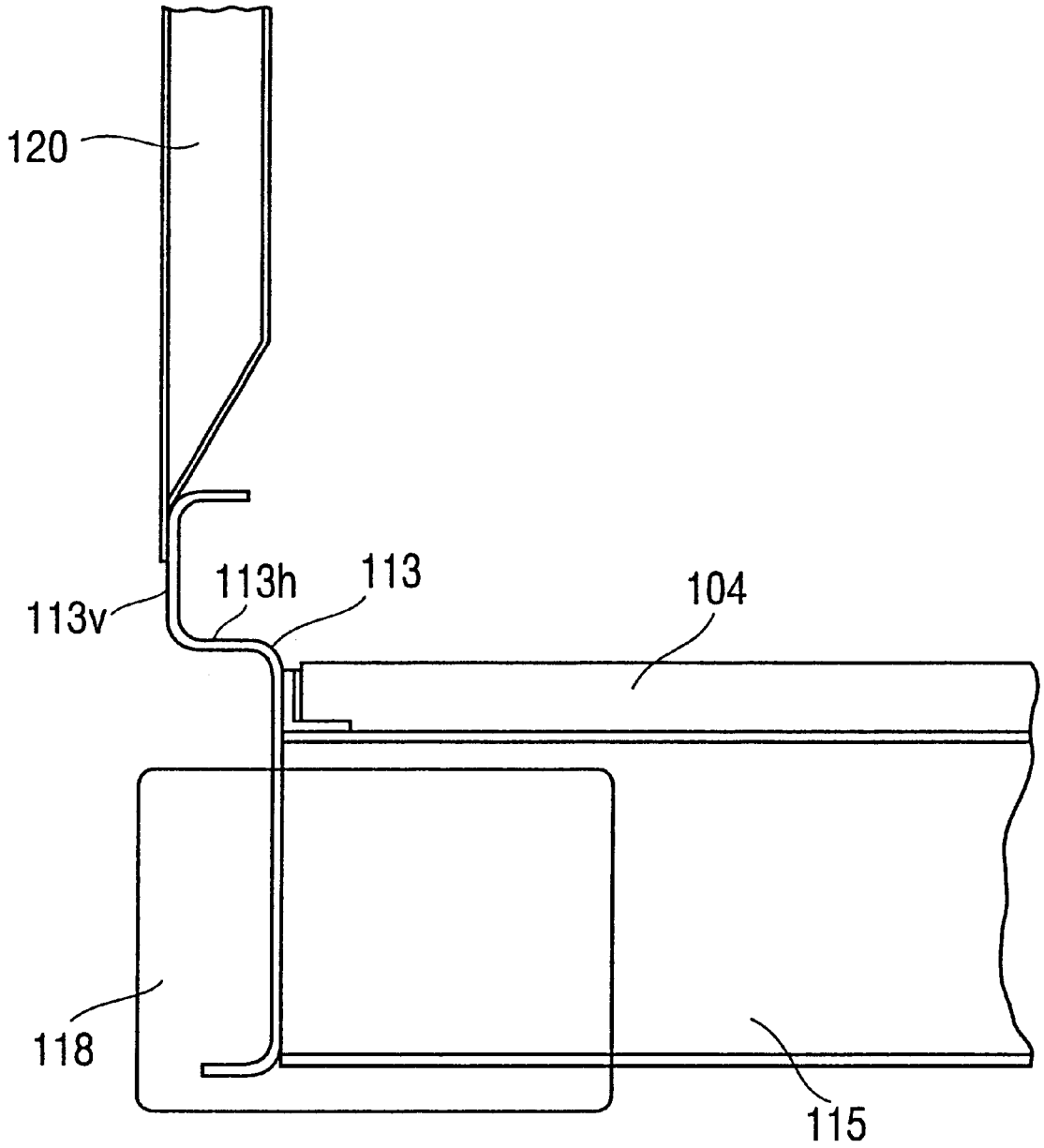
FIG. 10B illustrates a blown-up view taken along section 10B of FIG. 9.

FIG. 9 is a cross-section of the assembled container 100, showing the side panels 120 and the roof panel 122. FIGS. 10A and 10B show the blow up of sections 10A and 10B. Referring to FIG. 10A, the top end of the left side panel 120 is welded to an outer vertical side or portion 114*v* of the side rail 114, with the ribs 54 extending inwardly. The left edge of the roof panel 122 is welded to the outer horizontal side 114*h* of the side rail 114 with the ribs extending outwardly.

Figure 10C:
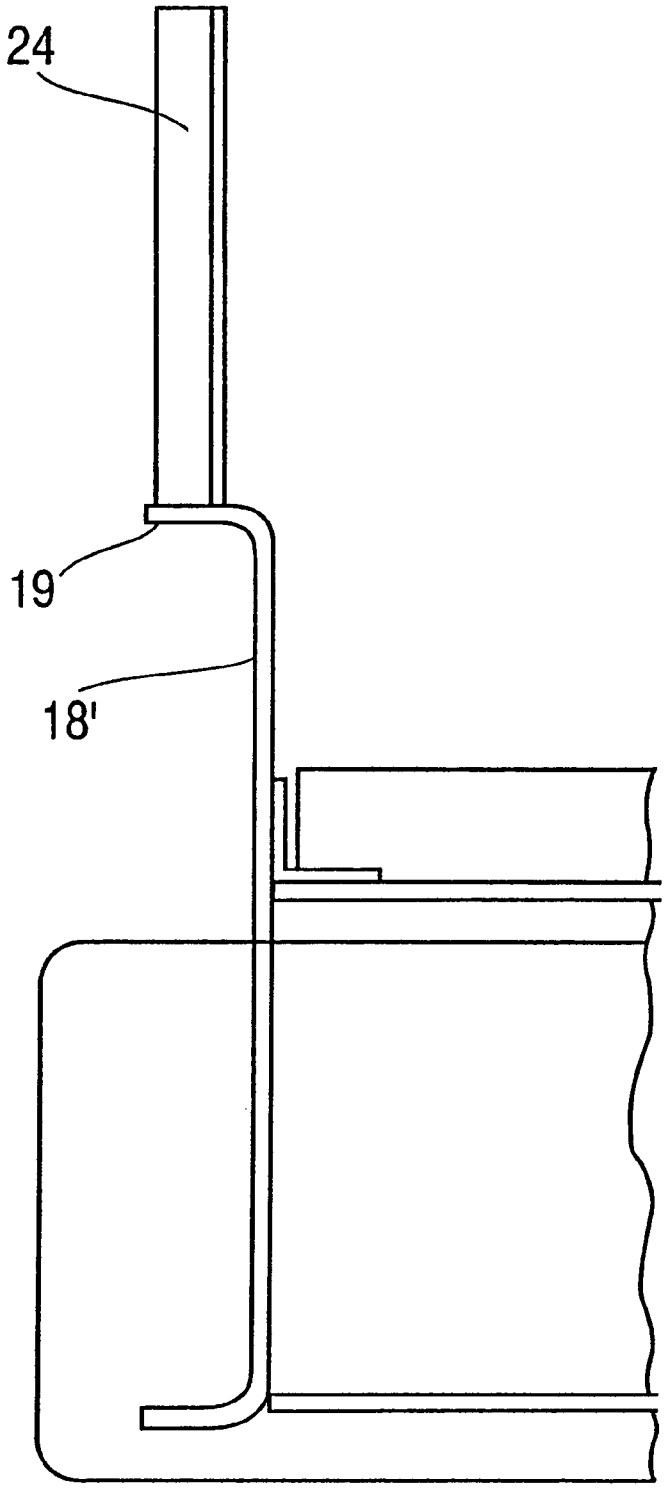
FIG. 10C illustrates a conventional base assembly.

The base assembly of a conventional ISO and Domestic cargo frame typically utilizes a U-shaped formed channel (side beam 18') as substantially illustrated in FIG. 10C. The lower edge of the conventional corrugated side panel 24 is welded to the horizontal top leg portion 19 of the side beam 18'. Because the path of the lower edge is not straight—corrugated (undulating)—it is difficult to automate welding. That is, it is more difficult to automate the welding of a corrugated surface than a straight surface.

According to one aspect of the invention, referring to FIG. 10B, the lower end of the side panel 120 is welded to a vertical portion 113*v* of the lower side beam 113. The lower side beam 113, as compared with the conventional side beam 18' (shown in FIG. 10C) is as follows. The conventional lower side beam 18' does not provide an outwardly exposed vertical side. Therefore, to provide such a side, the lower side beam is modified as shown in FIG. 10B, which shows the lower left side beam 113. Specifically, the upper portion of the beam 113 has an intermediate horizontal portion 113*h* that extends horizontally. The vertical portion 113*v* extends from the left most portion of the horizontal portion 113*h*. An upper horizontal portion 113*h*' extends inwardly from the upper most portion of the vertical portion 113*v*. The beam 113 essentially has an S-shaped cross-section. The right side beam is a mirror image of the left side beam 113. In fact, the entire right side is a mirror image of the left side.

Because there is no undulating surfaces or changing direction where the welding takes place, the panel according to the present invention can be easily and economically welded, even by an automation using a mash seam or $CO_2$ laser welding technique. Specifically, the flat strips 52 can be aligned along the flat beam portions 113*v*, 114*v*, and 114*h* of the beams 113, 114 and welded. The shorter edges of the roof panel 122 can be mash-seam or laser welded to the upper horizontal portion of the cross beams 117. The shorter edges of each side panel 120 can also be mash-seam or laser welded to the flat portions of the vertical posts 116.

Conventional containers have the roof or side panels attached to the front and door frame or assembly by means of sheet metal frame extensions (not shown). These frame extensions are welded to the frame and door frames during their fabrication and assembly. These frame extensions do not provide the necessary flat surface for the mash seam welding and are not rigid enough to withstand the pressure that the weld wheel can produce, e.g., in the order of 1.5 tons of pressure per weld head. The present panel construction 50 eliminates the need for such frame extensions because it is attached directly to the respective upper and lower cross and side beams 117, 115, 114, 113, although it can be used with metal frame extensions if desired. In that case, the metal frame extensions should have a U-shaped channel or other strengthening reinforcement, similar to the lower S-shaped beam 113 shown in FIG. 10B to withstand the weld head pressure.

The beams used for forming the frame 110 can be any suitable conventional cargo framing material, as described before. According to another aspect of the invention, certain portions or the entirety of the frame 110, including the base frame, is made from tubular members (113', 114', 115', 116', and 117'), such as conventionally available rectangular or L-shaped welded hollow steel tubing. See FIGS. 16–20. The strength and rigidity of the hollow steel tubing, compared with presently used customary bent sheet metal angles and channels, permit a reduction in parts required to achieve the required structural rigidity and integrity. Fewer parts require less labor to assemble the container. The tubular members can also simplify and make automatic welding more practical and simplify the welding process and the container assembly.

Figure 16:
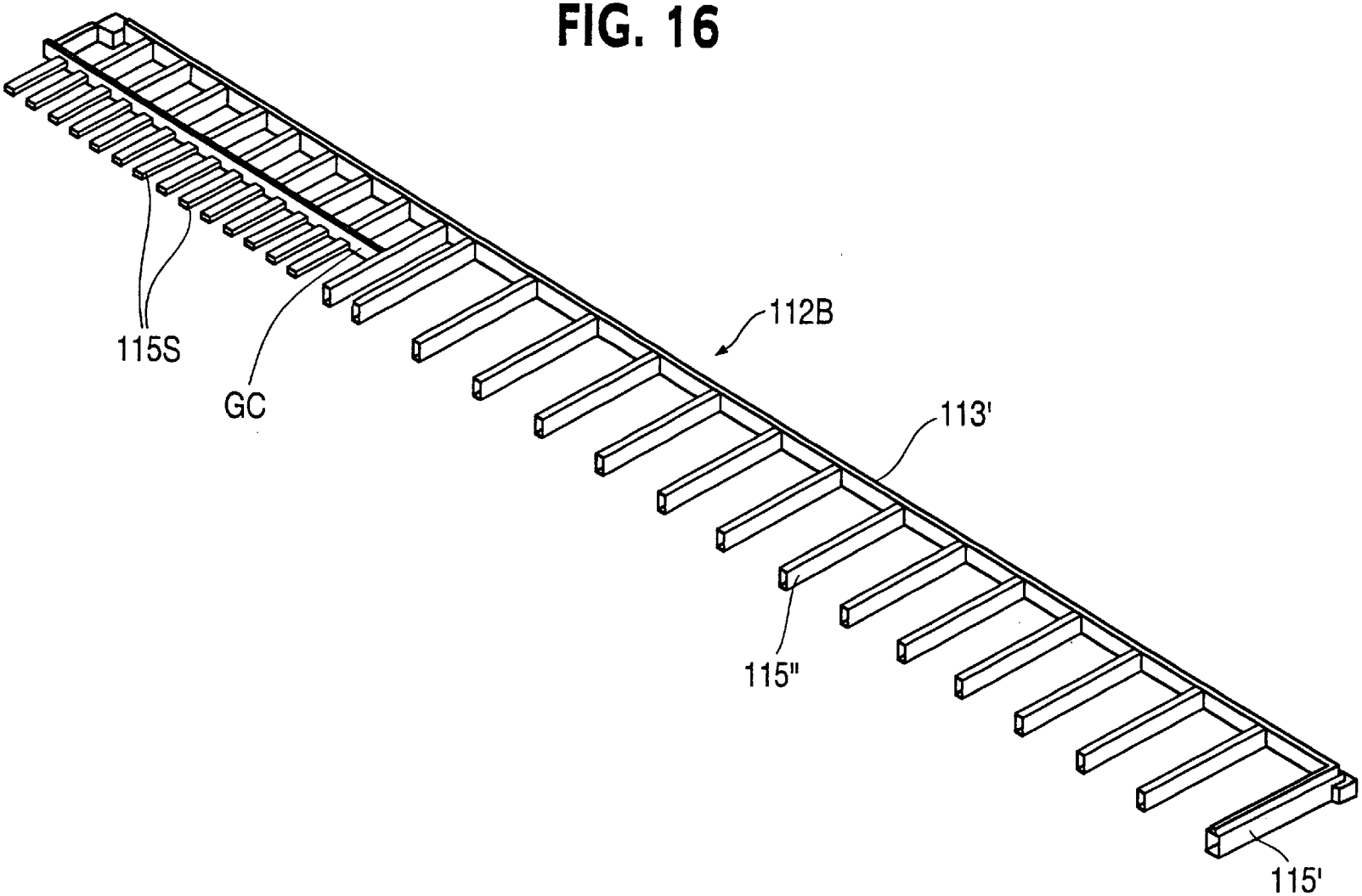
FIG. 16 illustrates a cross-sectional perspective view of the base frame according to another aspect of the present invention.

FIG. 16 shows a cross-sectional perspective view of the base frame 112B. In this embodiment, the base assembly 112 comprises the base frame 112B constructed of tubular members and a floor panel (104', see, FIGS. 17 and 18). The base frame 112B here includes two lower tubular side beams 113' (only one shown), two lower tubular cross beams 115' (only one shown), and a plurality of intermediary cross beams 115". There are two longitudinally extending beams GS (only one shown) and support beams 115S extending between them. The extending beams GS are for accommodating a truck trailer, to provide "gooseneck" clearance. Tubular members provide a greater structural integrity with less component. The current customary multiple strip wood floor 104, similar to a home floor, can be replaced with a single double-wide sheet steel floor (104', see FIGS. 17 and 18) that is seam welded to the side and cross beams 113 and 115, similar to the manner in which the roof panel 122 is attached to the upper side rails 114 and the upper cross beams 117. The seam weld technique can be used to hermetical seal the container. The exposed floor surface can be coated with a non-skid surface after the welding. If the floor is of the present panel construction 50, the ribs 54 should extend upwardly (toward the interior). Additional floor panels can be used in conjunction with the panel 50 if a flat surface is desired. The raised ribs, however, provide spaces, which can provide air or gas circulation paths, which may be important for organic cargo.

Figure 17:
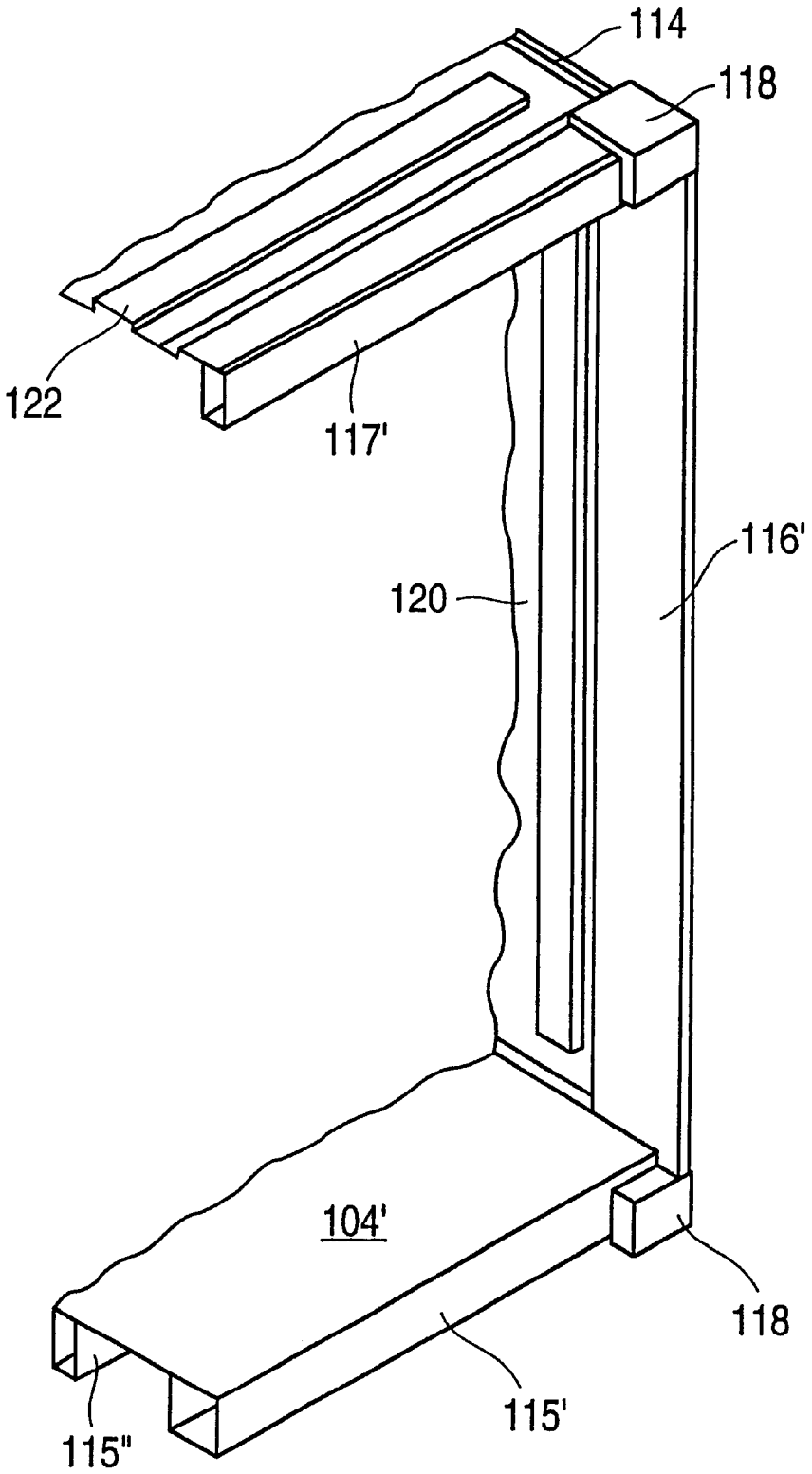
FIG. 17 illustrates a cross-sectional perspective view of the container construction using tubular frame members.
Figure 18:
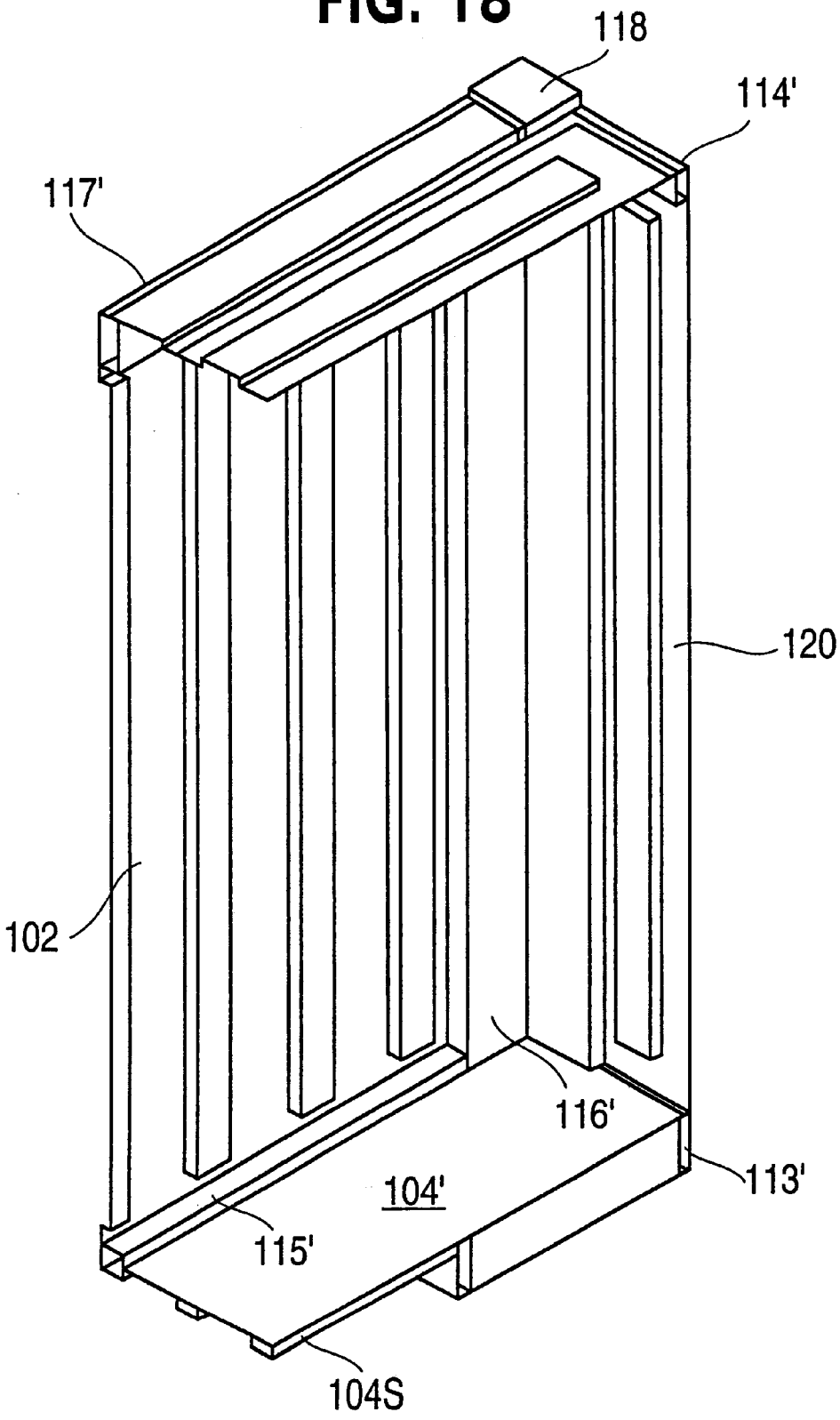
FIG. 18 illustrates another cross-sectional view of the container frame construction using tubular frame members.
Figure 19:
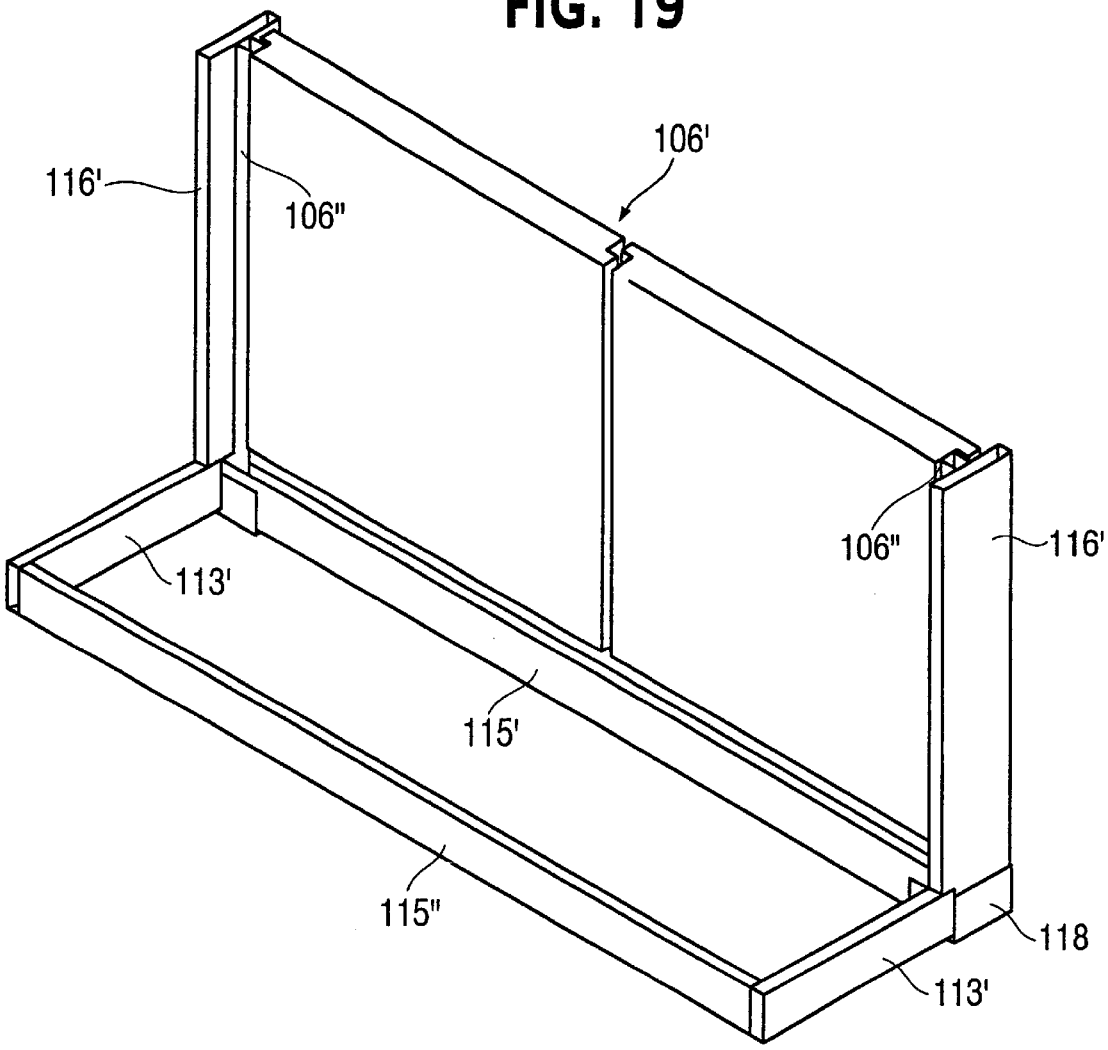
FIG. 19 illustrates a perspective view of the door assembly that can be used with reefer and atmospherically controlled containers according to the present invention.

FIGS. 17–19 illustrate the tubular construction of the frame 110 in more detail. FIG. 17 shows a blown-up view of the right end side (door panel) of the container (see FIG. 8 for orientation), illustrating the tubular vertical post 116', the rear right corner fitting 118, the rear tubular lower cross beam 115', the rear tubular upper cross beam 117', the right tubular side beam 114', and the floor 104'. FIG. 17 also shows the manner in which the edges of the roof panel 122 is positioned relative to the upper cross beam 117' and the side beam 114'. Again, the roof panel 122 has a cut out (not labeled) to accommodate the corner fitting 118 so that the end thereof can be welded to the cross beam 117' without the need for frame extensions. It should be noted that the cut out portion is welded to the cross beam 117' and preferably to the corner fitting 118 to provide a hermetical seal.

FIG. 18 shows the internal view of the front right end of the container, illustrating the front right tubular (L-shaped) vertical post 116', the front tubular lower cross beam 115', the lower right tubular side beam 113', the front upper cross beam 117', the right side panel 120, and the front panel 102. FIG. 18 also shows how the upper and lower edges of the front panel 102 are juxtaposed respectively to the upper and lower cross beams 117' and 115', as well as how the upper and lower edges of the side panel 120 are juxtaposed respectively to the upper and lower side beams 114' and 113'.

FIG. 19 shows more clearly the rear tubular vertical posts 116 'in an environment of a door assembly 106' for an atmospherically controlled container. FIG. 19 illustrates an internal view of rear part (door) of the frame 110, showing the two vertical posts 116', the rear lower cross beam 115', the two lower side beams 113', and the intermediary cross beam 115". A pair of tubular vertical door mounting post 116" are connected to the vertical posts 166, such as by welding. Hinges (not shown) can be integrally formed or attached to these mounting posts (jamb) 116". The door assembly 106' for a refrigerating container should have a high degree of insulating value. It can be constricted similar to refrigerator doors, such as with plastic covered magnetic gaskets (not shown) that seal against the metallic door jamb. This seal, plus the conventional door locking hardware, permits maintenance of an internal positive pressure in the container. Leakage should be made as small as possible. Any lost gas can be automatically replenished with a conventional atmosphere control unit (not shown). See FIG. 20.

Figure 20:
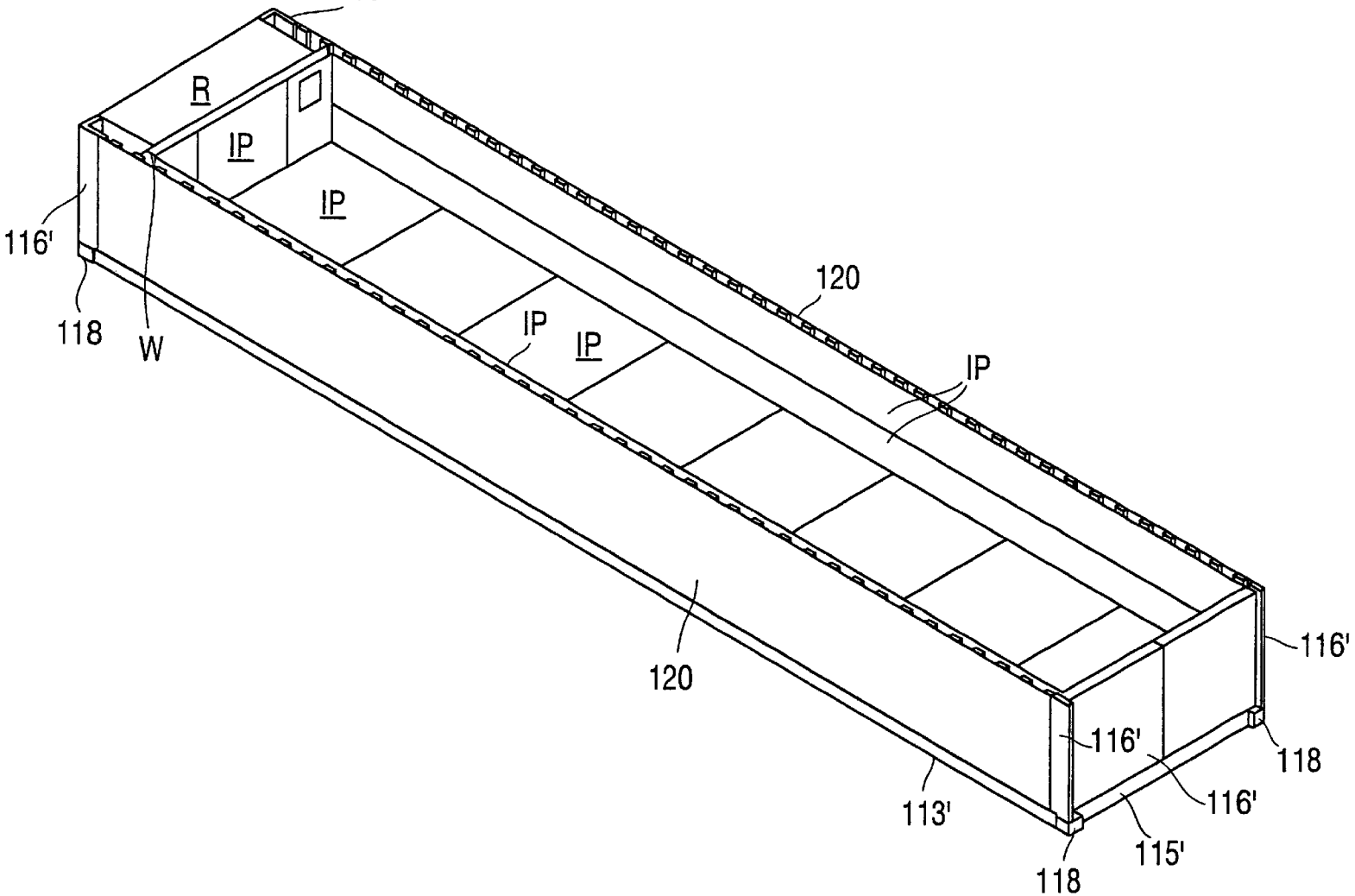
FIG. 20 illustrates a cross-sectional perspective view of another embodiment of a container according to the present invention, also illustrating an inner lining.

FIG. 20 schematically shows an example of a reefer (refrigerating container) atmosphere standard/humidity and oxygen, which can include an atmosphere control unit (oxygen or humidity or both), suitable for organic and inorganic products. Here, the frame members, namely the two lower side beams 113', the two upper side rails 114', the two upper cross beams 116', the two lower cross beams 115', and the four vertical corner posts 116' are all preferably formed of tubular members, as described above with respect to FIGS. 16–19, for greater structural integrity. The front vertical corner posts 116' are L-shaped as shown in FIG. 20.

The side, roof, and floor panels 120, 122, and 104' can be directly seam welded to these tubular members as described before. In particular the flat edge portion or welding strip 52 will be joined to the side of the beams that is parallel as shown in FIGS. 10A and 10B. In this embodiment, the front panel 102 is replaced with or is made with a cut out or other provision for receiving at least the exhaust or air inlet for a refrigerating unit or atmosphere control unit R, such as CARRIER TRANSICOLD systems, EVERFRESH and THINLINE NT/R, available from UNITED TECHNOLOGIES, and TECTROL Atmospheres available from TRANSFRESH Corp. See the attached brochures, the disclosures of which are incorporated herein by reference. In the embodiment of FIG. 20, a partition wall W, which can be made of the same panel construction 50, may be positioned between the control unit R and the door 116'.

The inside of the container is lined with insulating panels or liner IP. The liner is preferably formed from strips of metal that are mechanically lock-seamed or crimped into a rectangular tube. This makes cleaning easy and eliminates corrosion problem. This also permits the use of painted or unpainted galvanized steel, stainless steel, or aluminum. To minimize heat transmission, the liner is preferably mounted to the panels 120, 122, 104', and W, using plastic mounting members or spacers (not shown). Insulating foam, e.g., urethane, can be injected into the space between the exterior panels and the liner with an expanding internal mandrel and panels to eliminate deformation of the container during foam expansion. The foam also locks the liner in place. The door opening and the front opening can each also have four plastic sealing strips (not shown) that form a window frame around the liner opening. These four plastic strips also engage the roof, side, and floor panels to encapsulate the urethane foam injected between the panels and the liner.

Because the panels 102, 104', 120, and 122 are seam welded to the frame 100, the container will be sealed at least where the welding takes place, eliminating the need to separately seal the container.

According to the invention, all reefer containers have a controlled atmospheric control unit integral with the heating and cooling unit. Oxygen and humidity levers can be controlled to a desired level and monitored. The ripening of fruits and vegetables, and the opening of flowers, can be controlled so that they arrive fresh.

In addition, a controlled atmosphere dry cargo containers can be contemplated, which is not believed to have been contemplated before. The container according to the invention incorporates humidity and/or oxygen level in the container. This type of container can be used for carrying products that are not affected by temperature extremes, but are affected by humidity or oxygen, such as raw steel. Raw steel can be transported without rusting. Electronic components or equipment can be shipped without using desiccants. This type of container needs to be hermetically sealed and needs an oxygen removing device. One of the ways oxygen can be removed from the cargo container is by introducing nitrogen or other inert (non-reacting) gas into the container at a controlled pressure, which is at more than 1 atm to induce a positive pressure. The positive pressure will prevent oxygen from entering into the container. Nitrogen gas is commercially available and can be carried in pressurized tanks of 3000 psi and 4500 psi. Pressure regulators can be used to regulate the pressure in the container. Conventional humidity removing device can be incorporated to control the humidity level.

For safety, the container of this type should have a way of preventing nitrogen from entering the container while a person is inside while the outside door becomes closed. An additional safety inner door can be placed so that nitrogen gas is introduced into the container only upon closing both the inner and outer door. Additional cut-off safety switch, which can be activated by a person inside the container, can be positioned inside the container. Such a switch can be illuminated upon closing either of the inner or outer doors so that it is readily visible.

Figure 21:
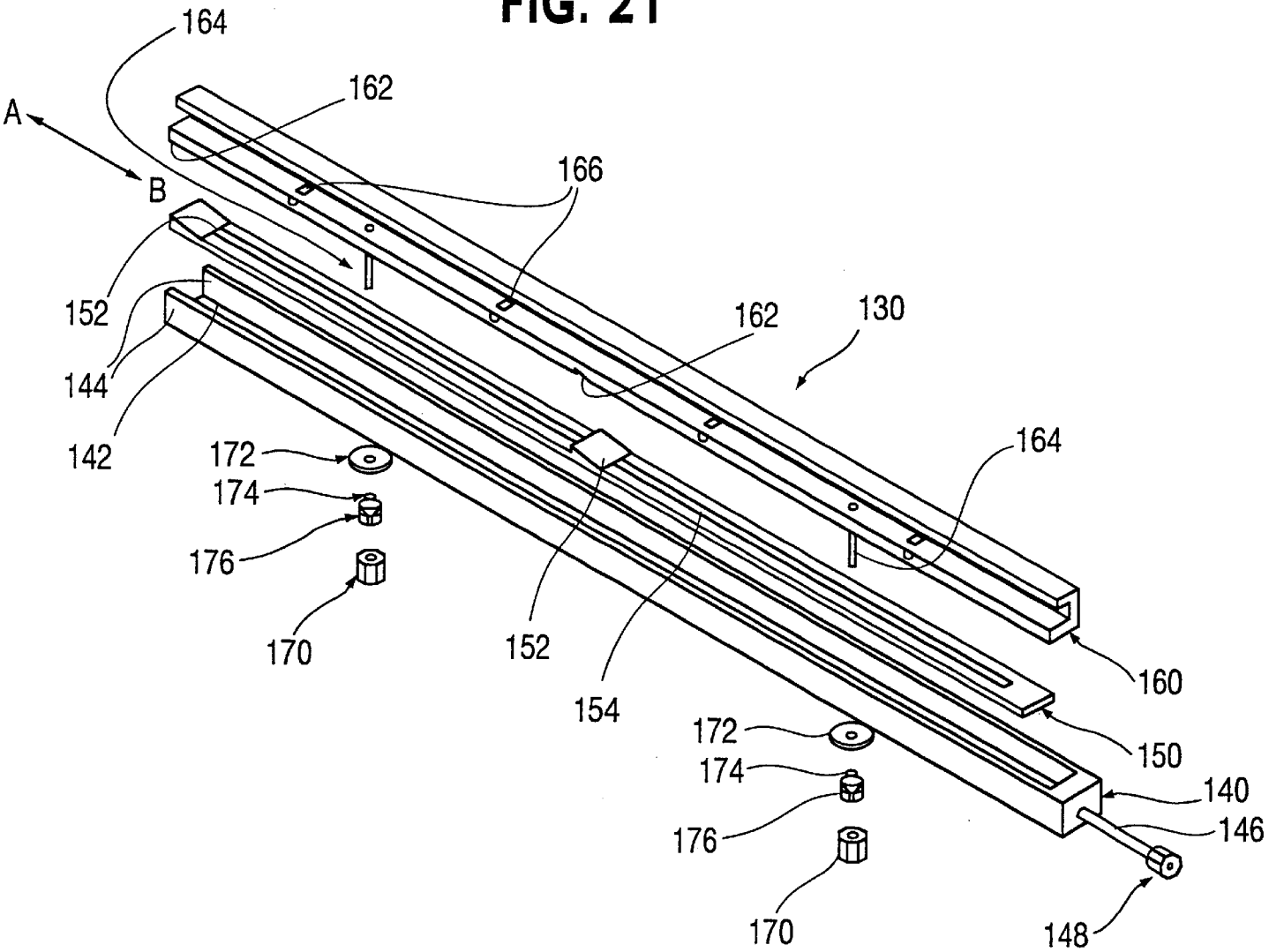
FIG. 21 illustrates an exploded perspective view of a pallet roller track assembly.

FIG. 21 illustrates an exploded view of a pallet roller track assembly 130 that can be incorporated in the container. The pallet roller track assembly 130 includes a base 140, a cam bar 150, and a pallet track 160. The base can be, as shown, a U-shaped (in cross-section) channel formed by a horizontal elongated member 142 and a pair of vertical elongated members 144 connecting the side edges of the horizontal member 142. The base receives the cam bar 150, which is formed of a substantially flat elongate member having a suitable width so that it can slide or move longitudinally relative to the base 140. To facilitate the longitudinal movement of the cam bar, the base has a threaded bar 146 extending longitudinally from one end of thereof as shown in FIG. 21. The threaded bar 146 is threaded to the base and rotatably connected to one end of the cam bar 150. Rotating the threaded bar 146 longitudinally moves the same in and out of the base 140. The threaded bar 146 has a nut 148 (fixed relative to the bar) to enable the threaded bar 146 to rotate together with the nut. The threaded bar 146 can be replaced with a solenoid or hydraulic actuator.

The cam bar 150 has cams 152 that engage the underside of the pallet track 160, which has complementary cam grooves 162 that mate with the cams 150 when the pallet track is lowered. That is, the cams 152 can raise or lower the pallet track 160 relative to the base 140. This is done by moving the cam bar 150 longitudinally relative to the base 140, as described earlier, with the threaded bar. For instance, moving the cam bar 150 toward the arrow A lowers the pallet track 160 until the cams 152 seat on the complementary cam grooves 162 and moving the same toward the arrow B (so that the cams 152 move away from the cam grooves 162) raises the pallet track 160.

The pallet track 160 is constructed similar to the base 140, except that the open end is facing the side instead of facing up—C-shaped cross-section. The pallet track 160 has a plurality of studs 164 extending downwardly from the lower side thereof. The studs 164 extend through longitudinally extending slots (extending between the cams 152) and into the horizontal member 142 of the base 140. These studs 164 extend through the floor 104, 104' of the container. The pallet track assembly 130 are connected securely to the container via the studs 164 and nuts 170, which along with washers 172, O-rings 174, and springs 176, act as fasteners. The washer 172 is first placed over the stud 176 from the outer side of the 25 floor, followed by the O-ring 174, the spring 176, and the nut 170. The springs 176 bias the pallet track 160 downwardly and they become compressed when the roller track is raised.

Pallets (not shown) are used to support and secure cargo to facilitate transport. One side of the pallet engages the pallet track 160. To facilitate the pallet movement, the pallet rides on the rollers 166 placed on the lower side of thereof. Two parallel pallet roller track assemblies 130 running longitudinally along the container can simplify loading and unloading. The two pallet track assemblies 130 can engage two parallel sides of pallets and clamp them securely in position and thus secure the cargo for transport to the container. Loading and unloading can also be automated using these pallet roller track assemblies 130.

Another unique feature of the pallet tracks assemblies 130 is that the pallets provide an air passageway beneath the cargo for usage in refrigerated or controlled atmosphere container or both. The container pallets are supported by the pallet tracks 160, for example, 50 mm above the floor. This 50 mm spacing acts as a duct for the output of the refrigeration and heating unit. They can replace the T-bar floor used in conventional reefers. The pallets have openings or vents to distribute the incoming air upward toward the cargo. The space above the top of the cargo and the inside top of the liner can acts as return ducts.

III. Panel and Cargo Assembler

Figure 11A:
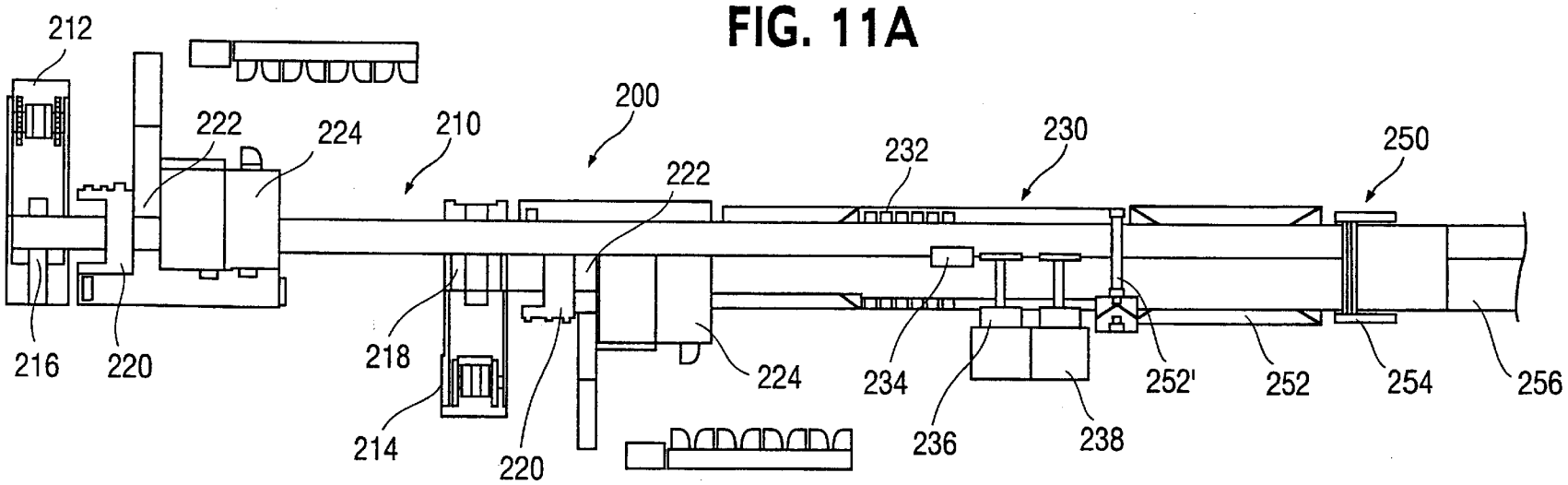
FIGS. 11A and 11B schematically illustrate a panel assembler that can be used for forming the panel according to the invention.
Figure 11B:
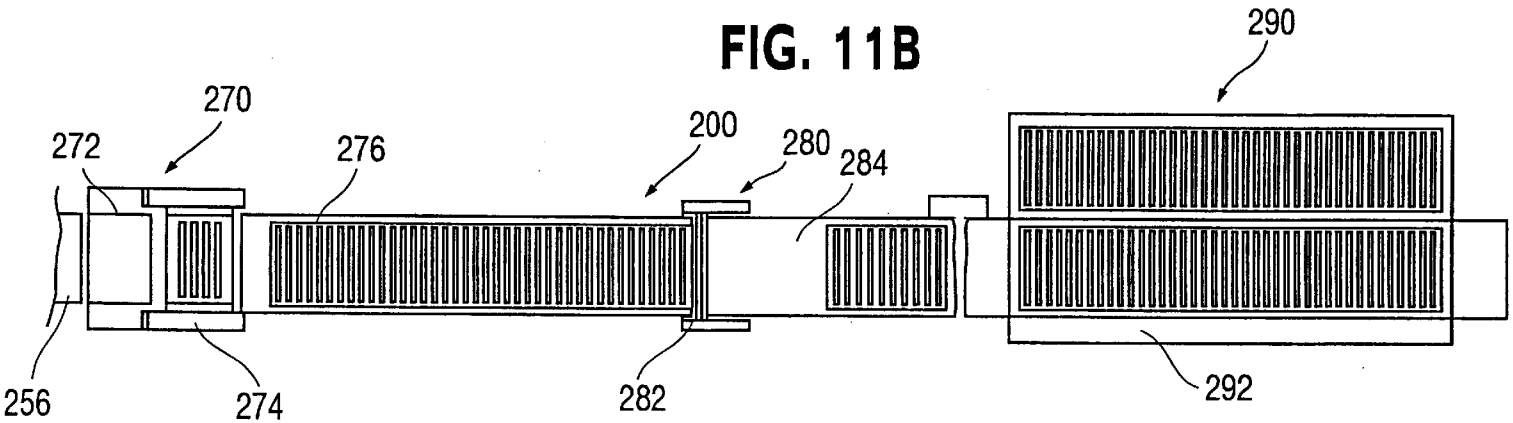
Figure 12:
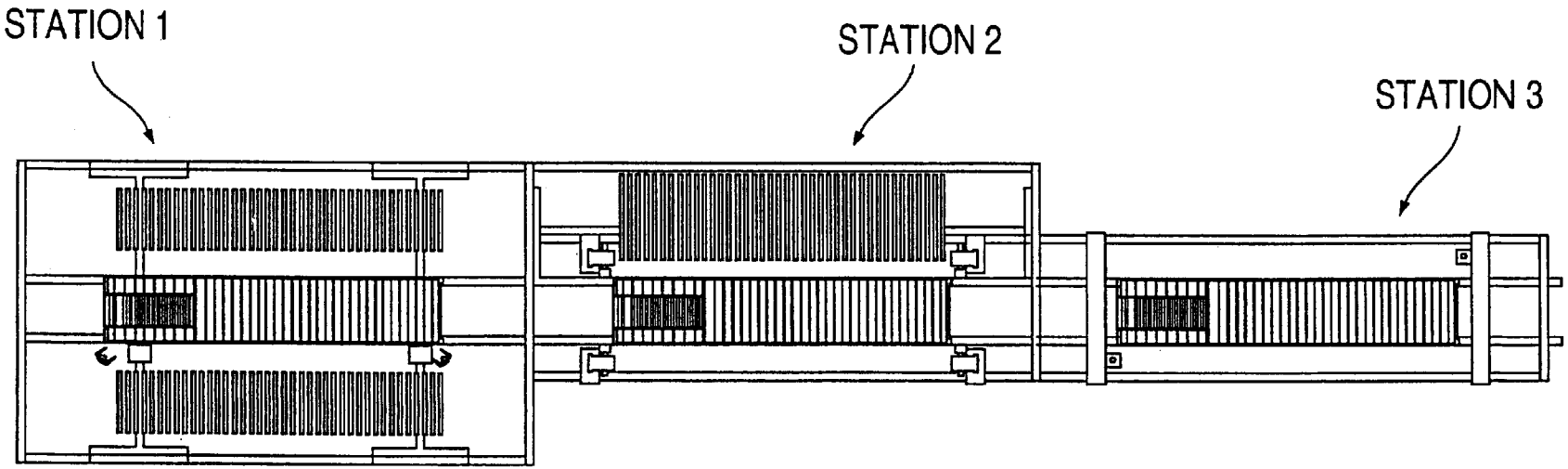
FIG. 12 schematically illustrates a container assembler according to the invention.

FIGS. 11A and 11B schematically illustrate an assembler 200 adapted for forming the present panel construction 50, which can be made to any desired size. The assembler 200 utilizes known sheet metal working machinery. According to the invention, a typical 40' by 8' wide by 8'6" high container, for example, can be assembled from two continuous sheets, each 4 feet wide (the upper and lower side rails or beams making up the height difference).

As shown in FIG. 11A, the assembler 200 includes an uncoiler station 210, a seam welding station 230 downstream of the uncoiler station 210, a length shearing station 250 downstream of the seam welding station 230, a pressing station 270 downstream of the length shearing station 250, a heel and toe shearing station 280 downstream of the pressing station 270, and a stacking station 290 downstream of the heel and toe shearing station 280.

The uncoiler station 210 includes first and second coil carriages 212, 214, which transport coils of metal sheet to first and second uncoilers 216, 218. Each uncoiler has an associated straightener 220, an edge trimmer 222, and a washer 224, which are all commercially available, for example, from SESCO of Ohio. This station uncoils the two metal sheets, flattens them, edge trims, and washes in preparation for mash seam or laser welding the inside adjacent edges together. The uncoilers hold, side-by-side, first and second reels of, for example, 4 feet wide commercial quality steel. The straightener can accurately feed the sheet onto a conveyor or table for aligning and positioning the two adjacent edges substantially side-by-side. The edge trimmer 222 trims the two adjacent edges to be welded. As shown in FIG. 11A, the second cradle uncoiler is positioned ahead or downstream from the first cradle uncoiler. The two adjacent edges are trimmed as the sheets are unrolled and conveyed downstream over the conveyor.

The side-by-side arranged double row of sheets of indefinite length is conveyed from the uncoiler station 210 to the seam welding station 230, which preferably has conventional skew rolls (side crowders) 232, along with "Z" bar lap controller 234, for guiding the overlapped sheets accurately through a mash seam or laser welder 236. The overlapping can vary as desired. The seam welder 236 applies high pressure and heat to seam weld the overlapped portion of the sheets to form, for example, approximately 95 ¾ inch wide panel—for a 8 foot high panel. The welding station can use, for instance, commercially available resistance or laser type heating elements. The upper and lower side beams 114, 113, depending on the size used, add another 6 inches to form a 8'6" high container.

After welding, conventional hot planish rolls or wheels 238 preferably flatten (planish) and/or smooth the welded seam. The planisher wheels 238 can reduce the thickness of the overlap to 110% to 120% of the single sheet thickness (i.e., reducing the overall thickness by 55% to 60%).

The planished continuous sheet (of indefinite length) is conveyed to the length shearing station 250, which includes a hump table or accumulator 252 and a pinch roller 252', an automatic back gauge shear 254, and a runout conveyor 256. Here, the planished sheet is precut to a predetermined length, e.g., 225" to 625" using the automatic back gauge shear 254. The hump table 252 and the pinch roller 252' is preferably positioned upstream of the shear to accommodate the continuously moving panel while the shear is clamping and shearing the indefinite length sheet into blank panels. The run-out conveyor 256 conveys the blank panels to the pressing station 270. See FIG. 11B.

The pressing station 270 includes a grip feeder 272 and a press and die assembly 274 and a first gauge conveyor 276. The precut blank panel is fed to the grip feeder 274, which indexes it through the press and die closings to form spaced ribs 54. Each stroke of the press and die can draw 4 or more ribs into a section of the panel and trim the outer edges of the panel at that section to prepare for a weld joint with the adjoining base 112 or frame member 110, e.g., the beams 113, 114, 115, 117. The trimming or flanging or both and the drawing process thus can be made essentially simultaneously. As the grip feeder 274 indexes the panel through the press, the trimmed edges of the panel can be pinched between side guides formed on the first gauge conveyor 276 to position the next section of the panel accurately so that the trimmed edges are continuously straight and parallel. The first gauge conveyor 276 conveys the completely ribbed panel to the heel and toe shearing station 280, as shown in FIG. 11B.

While the preferred embodiment shows the indefinite sheet being precut before forming the ribs, alternatively, the sheet of indefinite length can be first fed to the press and die to form the ribs before the sheet is cut to the desired length.

The heel and toe shearing station 280 has a shear 282 for sequentially trimming 1) the leading edge in relation to the pressed ribs and square to the trimmed edges, and 2) the trailing edge in relation to the ribs and square to the trimmed edges. The panel is now accurately dimensioned and ready for final assembly. A second gauge conveyor 284 conveys the finished panel to the stacking station 290.

The stacking station 290 includes a conventional magnetic overhead stacker (graphically represented by reference 292) for lifting the panel off the conveyor and stacking onto a pallet or the like to a desired number of panels for delivery to a container frame assembler 300 of FIGS. 12–15, for example, or a storage. It is preferable to stack the panel 50 with the ribs extending upwardly so that no foreign debris are accumulated in the cavities formed by the ribs 54.

In the configuration shown, all of the ribs 54 extend in the same direction. The reinforcing rib can have different depth and width, and profile. To alternate or change the direction in which the ribs extend or the shape thereof, different press and die configurations can be used. FIGS. 4A and 4B show examples of two different rib embodiments. For a 8'6" high container (8' panel), for example, the ribs can extend 94 inches high (length), 5 to 7 inches across (width) and 1.5 inches deep (depth), spaced apart 9 inch, from center to center. FIG. 4A shows a smooth arc shaped profile, whereas FIG. 4B shows a truncated cone or trapezoid-shaped profile. Of course, the ribs with different profile, length, width, and depth, can be formed as desired. For example, instead of a single long rib, a plurality of spaced apart shorter ribs can be used.

Figure 13:
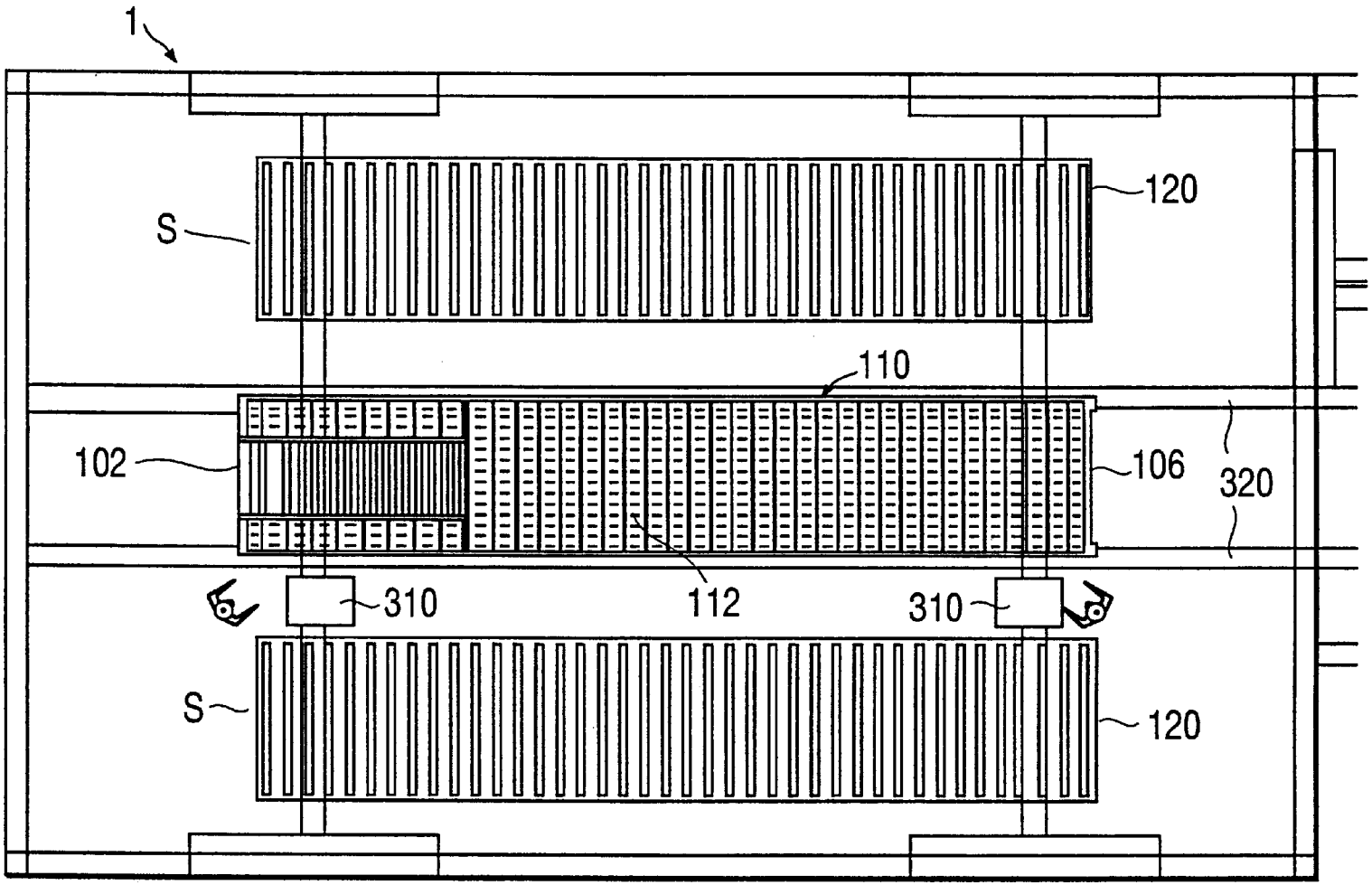
FIGS. 13–15 illustrate blown-up views of the container assembler of FIG. 12.
Figure 14:
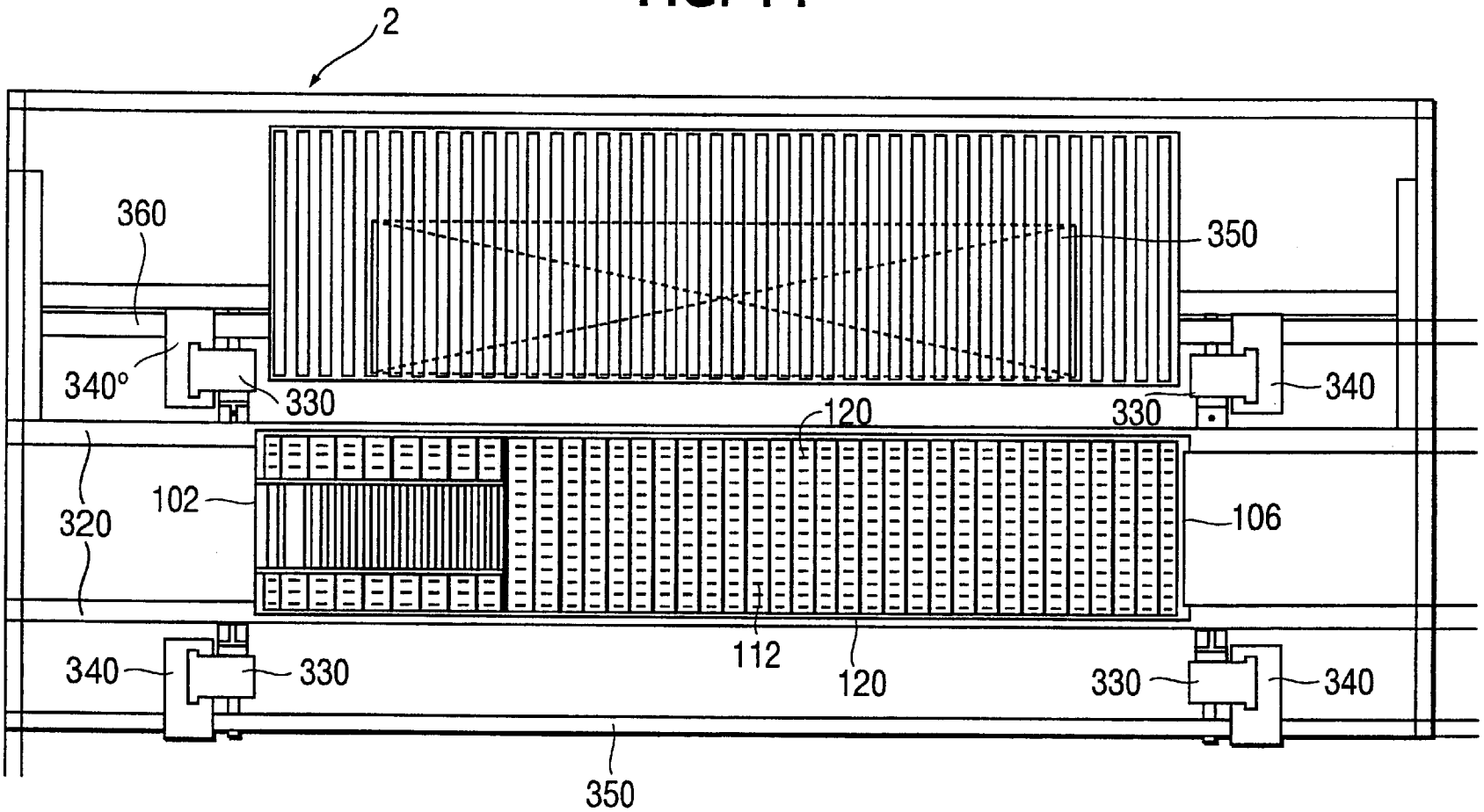
Figure 15:
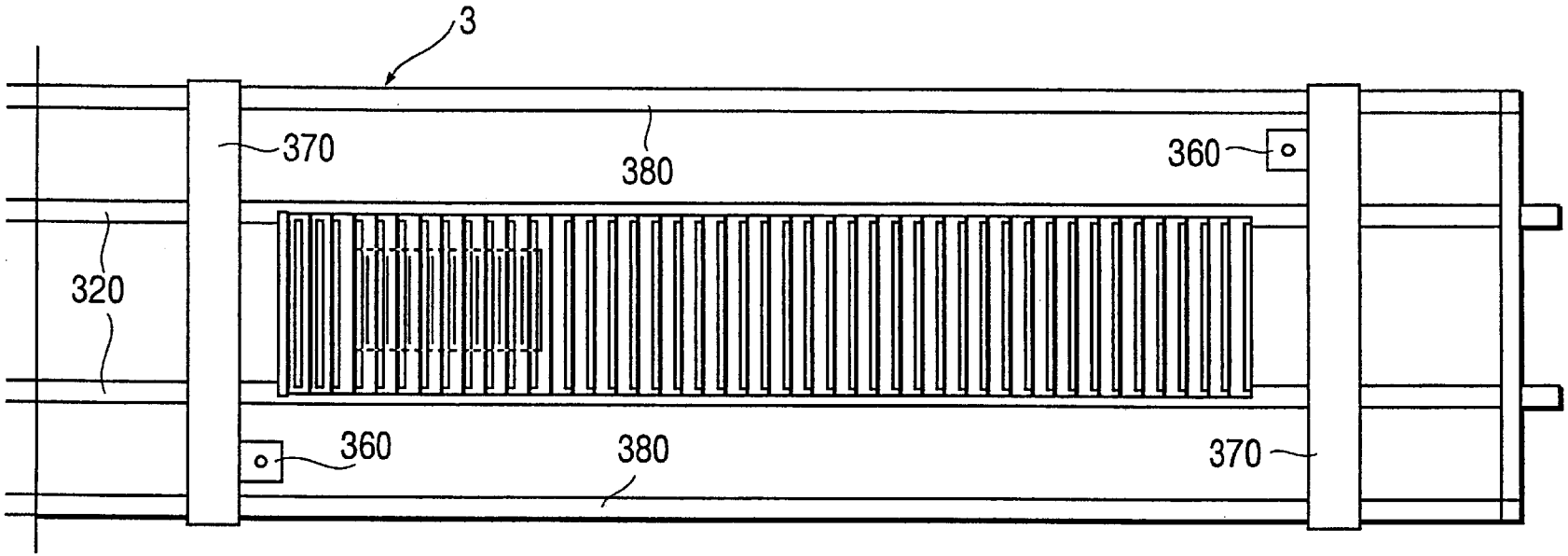

FIGS. 12–15 illustrate an embodiment of the container assembler 300 according to the invention, which includes stations 1–3. FIGS. 13–15 illustrate blown-up views of stations 1–3 of FIG. 12. Station 1 has a container assembly line having a stack S of the side panels 120 for a particular cargo model positioned to each side of the container assembly line. The side panel stacks S can be delivered by a conveyor, a truck, or a crane. Two overhead hoists 310 can be mounted over the two side panel stacks S and the container frame 110, which is preferably preassembled with the base assembly 112, the front panel 102, and the door panel 6 (or assembly) and positioned on an index conveyor 320. Two operators can operate the overhead hoists to lift the top panel of the stack S and move it into position at one side of the container frame. Hand held gauges can be used to accurately position the top corners of the side panel 120 to the container frame 110. After aligning, the operators can then tack weld the side panels 120 to the container frame, with the ribs extending inwardly into the container, to mainly hold the side panels 120 in place. The overhead hoists are then disengaged and moved to the opposite side of the container frame and the process is repeated. The same process can be used for assembling the roof panel to the container frame, but with the ribs extending upwardly.

Alternatively, an overhead hoist may be positioned at each side of the container assembly line, with a single operator completing the side panel loading and tack welding on each side of the container frame.

Alternatively, stacks of several models of the side panels can be riding on an indexing conveyor at each side of the container assembly line and the operator may index the desired stack into position to accommodate production of a different model.

Station 2 is an automated mash-seam or laser welding station positioned for completing the welding. After the side panels 120 are tack welded, the container is moved or indexed to station 2. The tack welded side panels 120 are automatically mash-seam or laser welded at their four welding strips 52 to the upper and lower side beams 114, 114' and 113, 113' and the vertical posts 116, 116' of the container frame to complete the assembly of the side panels. The welding can be done by one or two dual wheel weld head(s) 330 mounted to a vertical powered slide 340, which, in turn, is mounted to a horizontal powered slide 350.

The container frame is conveyed into position and clamped. Then the dual wheel weld head(s) 330 extend from a home position to contact the side panel 120 and the upper and lower side beams 114, 114' and 113, 113' and start the mash-seam weld or laser weld process. The mash-seam welding technology is available, for instance, from NEWCOR of Bay City, Mich. and SONDRONIC of Switzerland, the disclosures of which are incorporated herein by reference. As the welding current is applied, the horizontal or vertical slide moves the dual wheel weld head(s) along the selected seam. When the first seam is completed, the head is retracted and rotated 90 degrees, and then extended to produce the adjacent weld, e.g., vertical or horizontal. This process is repeated four times if only one weld head 330 is used per side panel or twice if two weld heads 330 are used per side panel, as is shown in FIG. 14.

Station 2 can include a single or multiple stacks of roof panels 122. An automatic destacker 350 is mounted on tracks that permit a single roof panel pick-up from one of the available stacks for positioning above the top of the upper side beams 114, 114'. When it has reached the required height, the destacker can move horizontally to a "pounce" position, over the container frame. When the side panel welding is completed, the destacker 350 lowers the roof panel to the top of the container frame. The operator can disengage the destacker from the roof panel 122, send it back for the next roof panel, and release the container assembly line conveyor to index the container to the next station.

The container, now with the loaded roof panel 122 is moved to station 3 to automatically mash-seam or laser weld the roof panel to the container frame. The welding can be done by one or two dual wheel weld head(s) 360 mounted to a powered cross slide 380, which, in turn, is mounted to a powered horizontal slide. The container is conveyed into position and clamped. Then, the dual wheel weld head(s) extends from a home position down to contact the roof panel and the container frame and start the mash-seam or laser weld process. As the welding current is applied, the horizontal or cross slide 380, 370 moves the dual wheel weld head along the selected seam. When the first seam is completed, the head is retracted and rotated 90 degrees, and then extended to produce the adjacent weld. This process is repeated four times if a single weld head is used or twice if two weld heads are used, as shown in FIG. 15.

The programmability of the travel of the dual wheel weld head(s) on the slides, the variable extension to the different models of the container frame, and the 90 degree indexing capability can facilitate the assembly of all present ISO, Domestic cargo, open top, ventilated, and refrigerated containers.

The index and clamp time for the container assembly line conveyor preferably will be approximately 60 seconds. The potential hourly output of the present container assembly line with one weld head per panel ranges from ten for the largest container models to twenty for the smallest container models. The addition of the second weld head per panel can reduce the weld cycle time by 50%, and the potential hourly output can be significantly increased.

A cargo container manufacturing can be significantly automated according to the present invention, using mash seam or laser welding technology. Manual wire-filled arc welds typically used to install the container side and roof panels can be replaced with automated mash-seam or laser welds. Automatic mash-seam or laser welding is faster, produces a quality weld, and protects employees from noxious and poisonous fumes. Automatic mash-seam or laser welding replaces the multiple sheets of corrugated steel used for the side and roof panels with continuous coils of steel, resulting in lower material costs and reduced material handling. Other suitable welding process can also be used, such as plasma arc welding and robotic wire-filled arc welding. The mash-seam welding technique, which can incorporate resistance, or the laser welding technique, is preferred to the other welding techniques because of weld speed and because no noxious fumes are produced.

The mash-seam and laser welding techniques produce a non-porous weld that will hermetically seal the seam. It is also able to accommodate coatings on the steel that reduce oxidation and rusting. The mash-seam welding uses current applied through the lapped joint. Two copper wheels, for instance, can be used to pass the welding current (resistance) through the lapped joint.

The present container is suitable for all current standard sizes of ISO and domestic dry cargo containers, open top, ventilated, and reefer containers, or any other custom sizes. Hermetically sealed containers can be produced according to the invention by sealing the floor and the door. Pressure equalizing device can be used to relieve distortion or stress. The interior of the container can also be filled with argon, nitrogen, or some inert gas to protect the product being shipped.

Given the present disclosure, one versed in the art would appreciate that there may be other embodiments, modifications, and acts, within the scope and spirit of the present invention. Accordingly, all modifications and acts attainable by one versed in the art from the present disclosure within the scope and spirit of the present invention are to be included as the present invention.

I claim:

1. A cargo container comprising:

a cargo frame assembly having at least a floor panel attached to the frame assembly; and a first pallet track assembly adapted to facilitate loading and unloading of cargo, wherein the pallet track assembly comprises a base attached to the floor panel, a cam bar movably mounted to the base, and a pallet track vertically movably mounted to the base.

2. A cargo container comprising:

a cargo frame assembly having at least a floor panel attached to the cargo frame assembly; and a first pallet track assembly adapted to facilitate loading and unloading of cargo, wherein the first pallet track assembly comprises a base attached to the floor panel, a cam bar movably mounted to the base, and a pallet track movably mounted to the base, wherein the cam bar comprises an elongated member, wherein the base comprises a U-shaped channel dimensioned to receive and allow the elongated member to slidably move longitudinally, and wherein the pallet track is vertically movably mounted relative to the base.

3. A cargo container according to claim 2, further including an actuator for longitudinally reciprocating the cam bar.

4. A cargo container according to claim 3, wherein the actuator comprises a motor driven threaded shaft threadlingly mounted to one end of the base and relatively rotatably mounted to one end of the cam bar to allow longitudinal displacement of the cam bar relative to the base upon rotating the shaft.

5. A cargo container according to claim 4, wherein the cam bar has a plurality of cams and the pallet track has a complementary cam grooves for seating the cams, wherein the cams lift the pallet track relative to the base when the cams are moved away from the cam grooves and lower the pallet track relative to the base when the cams are seated in the cam grooves.

6. A cargo container according to claim 5, wherein the pallet track is adapted to support at least one pallet for supporting cargo, the cam bar being adapted to immobilize the pallet relative to the base when the cam bar is positioned to lower the pallet track and adapted to allow the pallet to move longitudinally across the pallet track when the cam bar is positioned to lift the pallet track.

7. A cargo container according to claim 6, wherein the cam bar has at least one longitudinal slot and the pallet track has a plurality of studs extending through the slot and extending through the base and the floor panel.

8. A cargo container according to claim 7, wherein the pallet track has a plurality of rollers to assist longitudinal movement of cargo.

9. A cargo container according to claim 8, wherein the pallet track is substantially C-shaped in cross-section, having upper and lower horizontal portions joined by a vertical portion, the rollers being rotatably journaled to the lower horizontal portion thereof, the pallet being adapted to be positioned between the upper and lower horizontal portions thereof.

10. A cargo container according to claim 9, further including a second pallet track assembly positioned parallel to and substantially identical to the first pallet track assembly.

11. A cargo container according to claim 10, further including a refrigerating or atmosphere controlling unit, wherein the first and second pallet track assemblies are adapted to support the pallet, raised above the floor panel, wherein the pallet and the floor are adapted to act as a duct and distribute temperature controlled air from the refrigerating or atmosphere controlling unit.

12. A pallet track assembly for facilitating loading and unloading of cargo, comprising:

a base adapted to be attached to a floor panel of the cargo container;

a cam bar movably mounted to the base; and a pallet track vertically movably mounted to the base.

13. A pallet track assembly for facilitating loading and unloading of cargo, comprising:

a base adapted to be attached to a floor panel of the cargo container;

a cam bar movably mounted to the base; and a pallet track movably mounted to the base, wherein the cam bar comprises an elongated member, wherein the base comprises a U-shaped channel dimensioned to receive and allow the elongated member to slidably move longitudinally, and wherein the pallet track is vertically movably mounted relative to the base.

14. A pallet track assembly according to claim 13, further including an actuator for longitudinally reciprocating the cam bar.

15. A pallet track assembly according to claim 14, wherein the actuator comprises a motor driven threaded shaft threadlingly mounted to one end of the base and relatively rotatably mounted to one end of the cam bar to allow longitudinal displacement of the cam bar relative to the base upon rotating the shaft.

16. A pallet track assembly according to claim 15, wherein the cam bar has a plurality of cams and the pallet track has a complementary cam grooves for seating the cams, wherein the cams lift the pallet track relative to the base when the cams are moved away from the cam grooves and lower the pallet track relative to the base when the cams are seated in the cam grooves.

17. A pallet track assembly according to claim 16, wherein the pallet track is adapted to support at least one pallet for supporting cargo, the cam bar being adapted to immobilize the pallet relative to the base when the cam bar is positioned to lower the pallet track and adapted to allow the pallet to move longitudinally across the pallet track when the cam bar is positioned to lift the pallet track.

18. A pallet track assembly according to claim 17, wherein the cam bar has at least one longitudinal slot and the pallet track has a plurality of studs adapted to extend through the slot, through the base, and through the floor panel.

19. A pallet track assembly according to claim 18, wherein the pallet track has a plurality of rollers to assist longitudinal movement of cargo.

20. A pallet track assembly according to claim 19, wherein the pallet track is substantially C-shaped in cross-section, having upper and lower horizontal portions joined by a vertical portion, the rollers being rotatably journaled to the lower horizontal portion thereof, the pallet being adapted to be positioned between the upper and lower horizontal portions thereof.

* * * * *